US011992082B2

(12) United States Patent
Diard et al.

(10) Patent No.: US 11,992,082 B2
(45) **Date of Patent: *May 28, 2024**

(54) SOLE INCLUDING A SUPPORT MEMBER

(71) Applicant: Deckers Outdoor Corporation, Goleta, CA (US)

(72) Inventors: Jean-Luc Diard, Santa Barbara (FR); Stephen Liu, GuangZhou (CN); Stephen Kass, Carpinteria, CA (US); Vincent Bouillard, Ventura (FR); Christophe Aubonnet, Tresserve (FR)

(73) Assignee: Deckers Outdoor Corporation, Goleta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/183,919

(22) Filed: Mar. 14, 2023

(65) Prior Publication Data

US 2023/0284741 A1 Sep. 14, 2023

Related U.S. Application Data

(63) Continuation of application No. 17/384,783, filed on Jul. 25, 2021, now Pat. No. 11,633,007.

(51) Int. Cl.
*A43B 13/14* (2006.01)

(52) U.S. Cl.
CPC ..... *A43B 13/14* (2013.01)

(58) Field of Classification Search
CPC ..... A43B 13/14; A43B 13/183; A43B 13/185; A43B 13/186; A43B 13/125; A43B 3/0042
See application file for complete search history.

(56) References Cited

U.S. PATENT DOCUMENTS

| | | | | |
|---|---|---|---|---|
| 1,638,350 | A * | 8/1927 | Long | A63B 25/10 36/7.8 |
| 4,843,737 | A * | 7/1989 | Vorderer | A43B 21/30 36/38 |
| 4,881,329 | A * | 11/1989 | Crowley | A43B 13/183 36/38 |
| 4,910,884 | A * | 3/1990 | Lindh | A43B 13/18 36/27 |
| 5,138,776 | A * | 8/1992 | Levin | A63B 25/10 36/38 |
| 5,343,639 | A * | 9/1994 | Kilgore | A43B 13/183 36/35 B |
| 6,282,814 | B1 * | 9/2001 | Krafsur | A43B 7/1425 36/38 |
| 6,477,791 | B2 | 11/2002 | Luthi et al. | |
| 6,665,957 | B2 * | 12/2003 | Levert | A43B 13/182 36/27 |

(Continued)

FOREIGN PATENT DOCUMENTS

CN 107242642 A 10/2017

*Primary Examiner* — Bao-Thieu L Nguyen
(74) *Attorney, Agent, or Firm* — Greer, Burns & Crain, Ltd.

(57) ABSTRACT

An article of footwear including an upper, a sole attached to the upper, where the sole has a medial side and a lateral side, and a through-hole extending between the medial side and the lateral side, and a plurality of support members in the through-hole, where at least two of support members are a different size.

9 Claims, 19 Drawing Sheets

(56) References Cited

U.S. PATENT DOCUMENTS 6,886,274 B2 * 5/2005 Krafsur ..... A43B 13/183 36/27
7,334,351 B2 * 2/2008 Hann ..... A43B 13/16 36/102
7,335,138 B2 * 2/2008 Lee ..... A63B 25/08 482/79
7,484,317 B2 * 2/2009 Kita ..... A43B 13/141 36/27
7,624,515 B2 * 12/2009 Kita ..... A43B 13/141 36/27
7,730,635 B2 * 6/2010 Aveni ..... A43B 21/26 36/35 R
7,779,558 B2 * 8/2010 Nishiwaki ..... A43B 13/189 36/27
D641,798 S * 7/2011 Latham ..... D21/419
8,176,657 B2 * 5/2012 Schinlder ..... A43B 13/206 36/35 R
8,291,615 B2 * 10/2012 Kita ..... A43B 13/143 36/27
8,650,774 B2 * 2/2014 Aveni ..... A43B 13/184 36/27
8,984,775 B2 3/2015 Dombrow et al.
9,107,476 B2 * 8/2015 Kruglov ..... A43B 13/184
9,339,079 B2 * 5/2016 Lucas ..... A43B 13/187
9,399,153 B2 * 7/2016 Green ..... A63B 21/4013
9,451,805 B2 * 9/2016 Barnes ..... A43B 13/183
9,629,413 B2 4/2017 Stien
9,668,540 B2 * 6/2017 Scofield ..... A43B 13/181
9,968,160 B2 5/2018 Peyton
10,182,611 B2 1/2019 Auger et al.
10,383,390 B2 * 8/2019 Hsu ..... A43B 13/184
10,448,701 B2 10/2019 Farris et al.
11,122,859 B2 * 9/2021 Lee ..... A63B 71/0622
11,633,007 B2 * 4/2023 Diard ..... A43B 13/183 36/25 R
2002/0088142 A1 * 7/2002 Levert ..... A43B 13/182 36/27
2003/0163933 A1 * 9/2003 Krafsur ..... A43B 13/183 36/27
2004/0068891 A1 * 4/2004 Wang ..... A43B 21/30 36/27
2004/0154189 A1 * 8/2004 Wang ..... A43B 13/12 36/28
2004/0194347 A1 * 10/2004 Aveni ..... A43B 13/20 36/91
2005/0126039 A1 * 6/2005 LeVert ..... A43B 13/183 36/27
2006/0236562 A1 * 10/2006 Wang ..... A43B 13/026 36/29
2006/0265902 A1 * 11/2006 Kita ..... A43B 13/183 36/12
2006/0283045 A1 * 12/2006 Kita ..... A43B 13/12 36/28
2008/0034615 A1 * 2/2008 Nishiwaki ..... A43B 13/181 36/28
2008/0256827 A1 * 10/2008 Hardy ..... A43B 13/189 36/35 B
2010/0263228 A1 * 10/2010 Kang ..... A43B 21/42 36/29
2010/0269368 A1 10/2010 Nakatsuka
2011/0023328 A1 * 2/2011 Testa ..... A43B 13/181 36/114
2011/0138652 A1 * 6/2011 Lucas ..... A43B 13/14 36/28
2014/0068966 A1 * 3/2014 Chaffin ..... A43B 13/181 36/28
2014/0230280 A1 * 8/2014 Heard ..... A43B 7/38 36/102
2015/0027000 A1 * 1/2015 Barnes ..... A43B 13/183 36/87
2015/0157088 A1 * 6/2015 Seo ..... A43B 13/187 36/25 R
2015/0272272 A1 * 10/2015 Scofield ..... A43B 1/0009 36/28
2016/0058124 A1 * 3/2016 Lucas ..... A43B 7/144 36/28
2016/0183633 A1 * 6/2016 Scofield ..... A43B 13/20 36/29
2016/0262492 A1 * 9/2016 Fujita ..... A43B 13/186
2017/0055633 A1 * 3/2017 Hsu ..... A43B 13/184
2018/0192734 A1 * 7/2018 Möhlmann ..... A43B 7/082
2019/0104805 A1 * 4/2019 Del Biondi ..... A43B 13/125
2020/0297071 A1 * 9/2020 Troufanov ..... A43B 13/189
2021/0015209 A1 * 1/2021 Buck ..... A43B 13/184
2021/0037914 A1 * 2/2021 Adametz ..... A43B 13/185
2021/0368918 A1 * 12/2021 Lyke ..... A43B 13/189
2021/0368922 A1 * 12/2021 Ho ..... A43B 21/32
2022/0104584 A1 * 4/2022 Bazan ..... A43B 3/244
2023/0027940 A1 1/2023 Diard et al.

* cited by examiner

SOLE INCLUDING A SUPPORT MEMBER

CROSS-REFERENCE TO RELATED APPLICATIONS

This application is a continuation of and claims priority to U.S. patent application Ser. No. 17/384,783 filed on Jul. 25, 2021, the entire content of which is incorporated herein by reference.

BACKGROUND

The present application relates generally to footwear, and more particularly, to a sole including at least one support member within the sole that supports a user's feet while providing resilient energy to the user's legs and feet to optimize energy efficiency and propel the user during use such as during walking, jogging and running.

Running involves the transfer of energy between a person's legs and feet and an underlying surface, such as the ground, contributing to propelling a person forward along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. In particular, the propulsion generated by a person's legs and feet is important while walking, jogging or running. If a person's feet are not sufficiently supported by their shoes and their feet to do not have a stable push off point, less energy could be transferred from the person's feet to the ground to propel the person forward. Shoe constructions and the supportive systems in shoes are factors that help with proper force application and efficient energy transfer useful for walking or running. The lack of support could also cause a person's legs to tire more quickly and thereby affect their ability to walk, jog or run.

There are many different types of structures for footwear to facilitate running efficiency and optimal force application. For example, some shoes include midsoles and outsoles that are made of materials having different characteristics such as different hardness values, density and elasticity, which provide more support in some areas and less support in other areas of a person's foot leading to different shock absorption and propulsion behaviors. For example, harder materials could support to foot structures during the stance, helping a proper force application and energy transfer. In another example, a plate is inserted or embedded in the sole of a shoe to enhance the rigidity of the sole similar to harder materials. The plate is a supportive element as well as contributing to the performance attributes of a shoe while still allowing the other materials of the sole to provide cushioning in areas of the foot, such as the heel, to provide comfort.

It is therefore desirable to provide footwear that supports a person's feet during walking, jogging and running while optimizing force application and energy transfer to enhance a person's walking and running efficiency.

SUMMARY

The present article of footwear includes a sole having a through-hole and at least one support member positioned in the through-hole to enhance the stability and support to a user's foot during use of the article of footwear.

In an embodiment, an article of footwear is provided and includes an upper and a sole attached to the upper, where the sole has a medial side and a lateral side, and a through-hole extending between the medial side and the lateral side. A support member is positioned in the through-hole of the sole, where the support member includes an upper support and a lower support and where the upper support is spaced from the lower support.

In another embodiment, a sole for an article of footwear is provided and includes a midsole having a medial side and a lateral side, and a first through-hole and a second through-hole, where the first through-hole and the second through-hole each extend between the medial side and the lateral side. A first support member is positioned in the first through-hole and a second support member is positioned in the second through-hole, where the first and second support members each include an upper support and a lower support, and the upper support is spaced from the lower support.

In another embodiment, an article of footwear is provided and includes an upper, a sole attached to the upper, where the sole has a medial side and a lateral side, and a through-hole extending between the medial side and the lateral side, and a plurality of support members in the through-hole, where at least two of support members are a different size.

DETAILED DESCRIPTION

The present sole is attached to an upper to form an article of footwear to stabilize and cushion a user's foot during walking, jogging and running, while providing enhanced stability and spring energy for efficient propulsion. More specifically, the present sole includes a midsole and an outsole where at least one support member is located on or in the midsole or outsole to provide enhanced support in the user's feet and enable the user's feet to press against the support member and propel the user in a desired direction.

Figure 1:
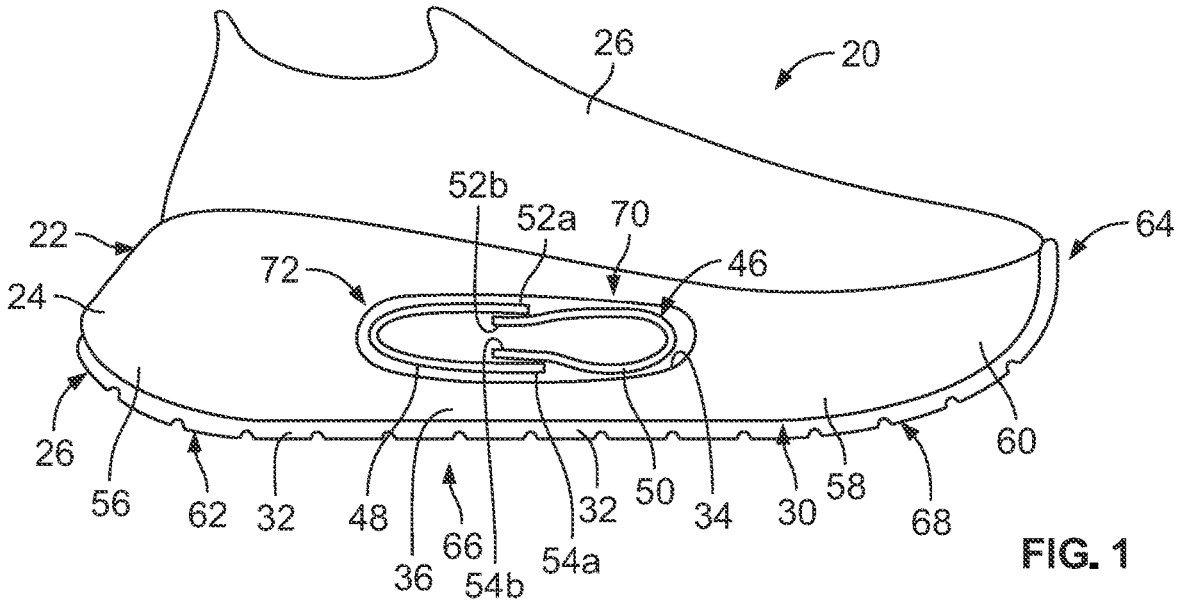
FIG. 1 is a perspective view of an article of footwear including the present sole.
Figure 2A:
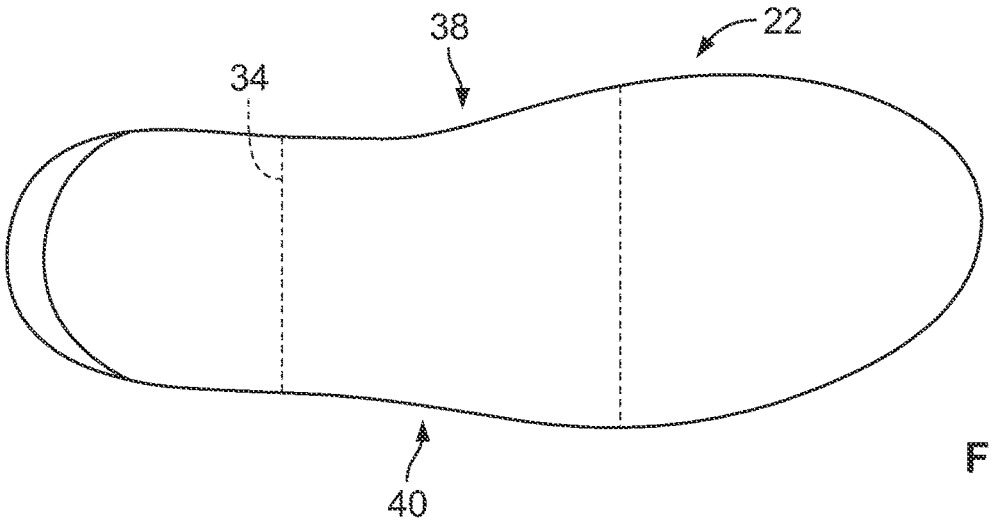
FIG. 2A is a top view of the embodiment of the article of footwear of FIG. 1 with the support member removed from the sole.
Figure 2B:
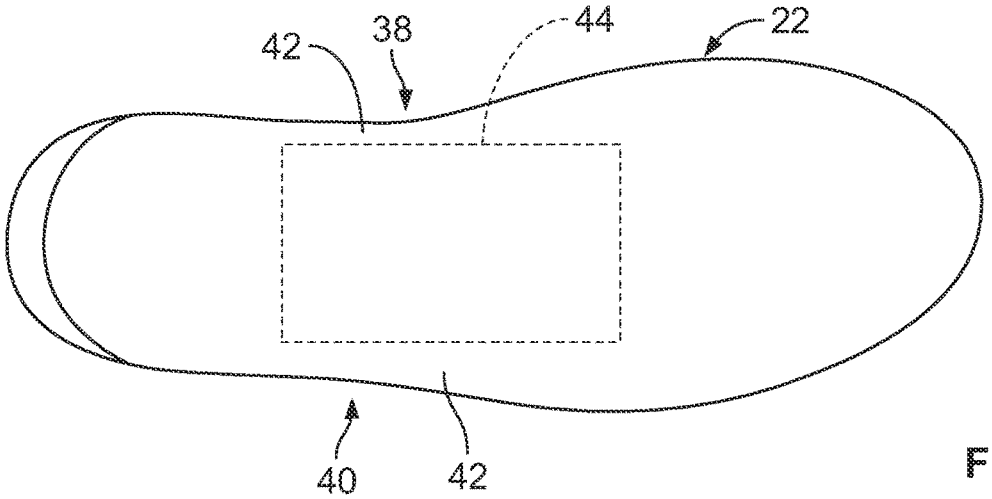
FIG. 2B is a top view of another embodiment of the article of footwear of FIG. 1 with a closed through-hole and with the support member removed from the sole.
Figure 3:
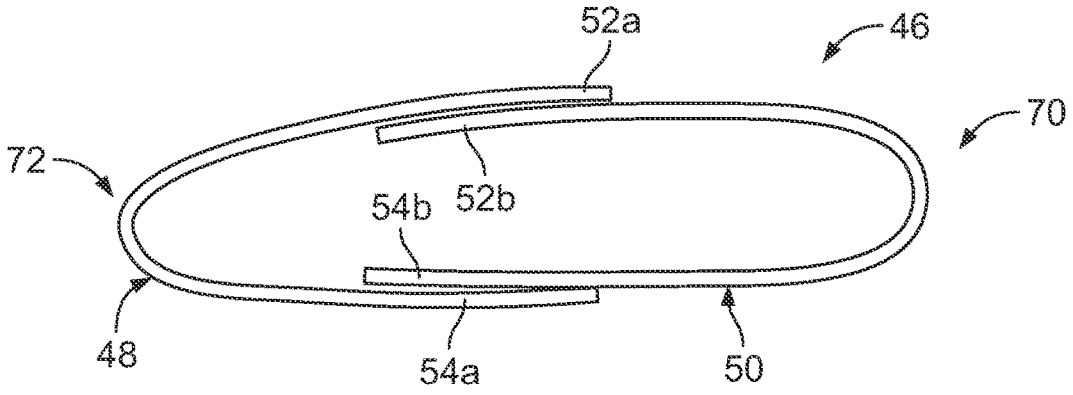
FIG. 3 is an elevational view of the support member in the sole shown in FIG. 1.
Figure 4:
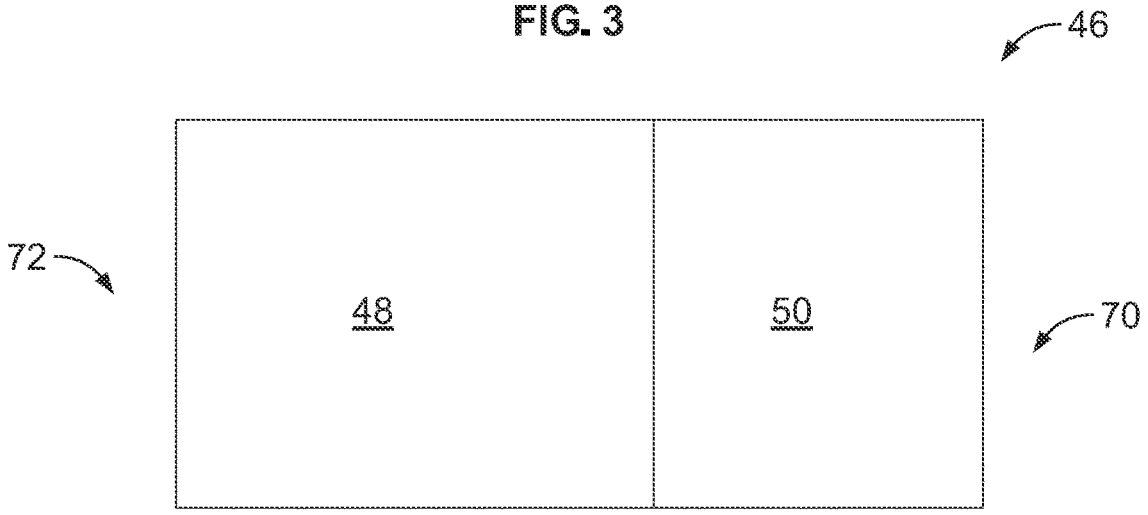
FIG. 4 is a top view of the support member shown in FIG. 3, wherein the bottom view is a mirror image thereof.
Figure 5:
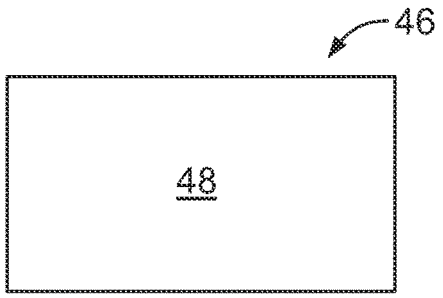
FIG. 5 is a rear view of the support member shown in FIG. 3.
Figure 6:
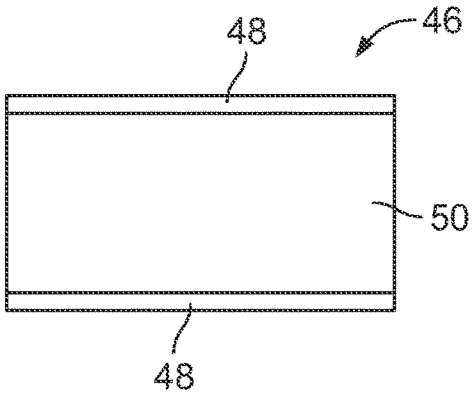
FIG. 6 is a front view of the support member shown in FIG. 3.
Figure 7:
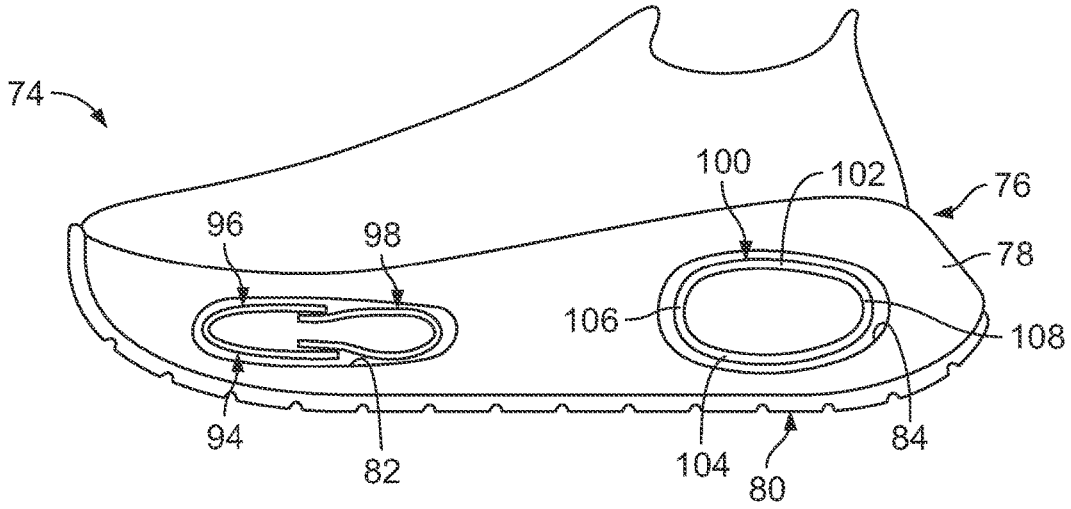
FIG. 7 is a perspective view of an article of footwear including another embodiment of the present sole.

Referring now to FIGS. 1, 2A and 2B, an article of footwear 20 includes an embodiment of the present sole, generally indicated as 22, where the sole 22 includes a midsole 24 attached to an upper 26, and an outsole 28. The midsole 24 may be an integral, molded component made of a material having a designated hardness value or made with different materials having the same or different hardness values. For example, one or more portions of the midsole 24 may be made with a material having a hardness or hardness value that is greater than a hardness or hardness value in other areas of the midsole to increase the stability and support in designated areas of the midsole. In an example embodiment, the midsole 24 includes a first material layer made of a foam material, and a second material layer made of Ethylene-vinyl acetate (EVA) or an EVA foam material. In another example embodiment, the midsole is made solely of a foam material, EVA or another suitable material or combination of materials. As shown in FIG. 1, the outsole 26 is attached to a bottom surface 30 of the midsole 24 by an adhesive or by molding, and is made of rubber. In the illustrated embodiment, the outsole 26 includes a plurality of tread members 32 that are configured to at least partially grip an underlying surface, such as the ground, during movement. It should be appreciated that the midsole 24 and outsole 26 may each be made of any suitable material or combination of materials.

As shown in FIG. 1, the sole 22, and more specifically, the midsole 24, includes a through-hole 34 in a midfoot area 36 that extends from the medial side 38 to the lateral side 40 of the midsole. In this embodiment, the through-hole 34 is exposed on the medial side 38 and on the lateral side 40 of the sole 22. In another embodiment, shown in FIG. 2B, both ends 35*a*, 35*b* of the through-hole 34 are closed by a portion or wall 42 of the sole 22 to form an internal compartment 44 that includes support member 46. Alternatively, one of the ends of the through-hole 34 may be open or exposed to the environment and the opposing end is closed by the portion of the sole.

The support member 46 is positioned in the through-hole 34 to provide enhanced support and resiliency or spring to a user's foot during movement. As shown in FIGS. 1 and 3-6, the support member 46 comprises a first spring member 48 and a second spring member 50 that each have a C-shape. The first spring member 48 and the second spring member 50 each have upper ends 52*a*, 52*b* and lower ends 54*a*, 54*b* where the upper end 52*b* and the lower end 54*b* of the second spring member 50 are positioned between the upper end 52*a* and the lower end 52*b* of the first spring member 48 such that the first spring member at least partially overlaps the second spring member. In the illustrated embodiment, the support member 46 is preferably made of a resilient material, such as a resilient metal, that has a rigidity to provide a designated level of support to an area or areas of a user's foot, and a compressibility to provide spring to the area or areas of the user's foot. The resiliency or spring provided by the first spring member 48 and the second spring member 50 of the support member 46 is determined by the sizes of the first and second spring members, such as the length and width of the first and spring members as well as the distance between the upper ends 52*a*, 52*b* and the lower ends 54*a*, 54*b* of the first and second spring members. Also, the thickness of the first and second spring members 48, 50 affects the resiliency or spring provided by the support member 46. For example, certain parts of the first and second spring members 48, 50 may have a thickness that is greater than a thickness of other parts of the first and second spring members to provide more rigidity and support to certain areas of a user's foot. Similarly, certain parts of the first and second spring members 48, 50 may have a thickness that is less than a thickness of other parts of the first and second spring members to provide more flexibility and spring in certain areas of the user's foot. Additionally, the material used to make the first and second spring members 48, 50 may be more rigid or less rigid to alter the support provided by the support member 46 or may be more resilient or less resilient to alter the spring (spring energy) provided by the support member to a user's foot. It should be appreciated that the first and second spring members 48, 50 forming the support member 46, may be made of a metal, a composite material or any suitable material or combination of materials. Further, the first and second spring members 48, 50 may be made of the same material or different materials depending on the desired level of rigidity and resiliency provided by the support member 46.

In the above embodiments, the through-hole 34 and the support member 46 may be located in the heel area 56, the midfoot area 36, the forefoot area 58 and the toe area 60 of the sole 22 or extend at least partially into two or more of these areas of the sole. The location of the through-hole 34 and support member 46 is based on the area or areas in which support is desired for a user's foot. For example, placing the through-hole 34 and the support member 46 in the heel area 56 provides enhanced support and resiliency or spring to a user's heel during movement. Similarly, placing the through-hole 34 and the support member 46 in the midfoot area 36 or the forefoot area 58 provides enhanced support and spring to these areas of the user's foot during movement.

The support and resiliency provided by the first spring member 48 and the second spring member 50 of the support member 46 may be the same or may be different. In an embodiment, the first spring member 48 is more rigid and less flexible or compressible than the second spring member 50 such that the rear end of the support member 46 provides more rigid support (less cushioning) and less resiliency (spring energy) to a user's foot than front end of the support member 46. In another embodiment, the second spring member 50 is more rigid and less resilient or compressible than the first spring member 48 such that the front end of the support member 46 provides less cushioning and resiliency (spring energy) to a user's foot than the rear end. It should be appreciated that the first and second spring members 48, 50 may be configured with any suitable level of rigidity and flexibility or compressibility to adjust the support and resiliency (spring energy) provided to different areas of a user's foot.

During movement, such as during walking, jogging or running, the heel 62 of the article of footwear or shoe 20 typically strikes or contacts the ground first and then rocks toward the front end 64 of the shoe where the midfoot area 66 of the shoe contacts the ground followed by the forefoot area 68 of the shoe. When the support member 46 is positioned in the midfoot area 36 of the sole 22 as shown in FIG. 1, the front end 70 and the rear end 72 of the support member 46 are compressed by a user's foot when the midfoot area 66 contacts the ground. In an embodiment, when the first and second spring members 48, 50 of the support member 46 have the same level of rigidity and flexibility or compressibility, then the first and second spring members provide the same general level of support and resiliency (spring energy) to the mid foot area of the user's foot. In another embodiment, when the first and second spring members 48, 50 of the support member 46 have the different levels of rigidity and flexibility or compressibility, then the first and second spring members provide different levels of support and resiliency (spring energy) to the mid foot area of the user's foot. It should be appreciated that the level of rigidity and the level of flexibility or compressibility of the first and second spring members 48, 50 may be adjusted to accommodate different types of terrain or different uses of the shoe such as walking, jogging or running over short distances or long distances.

Figure 8:
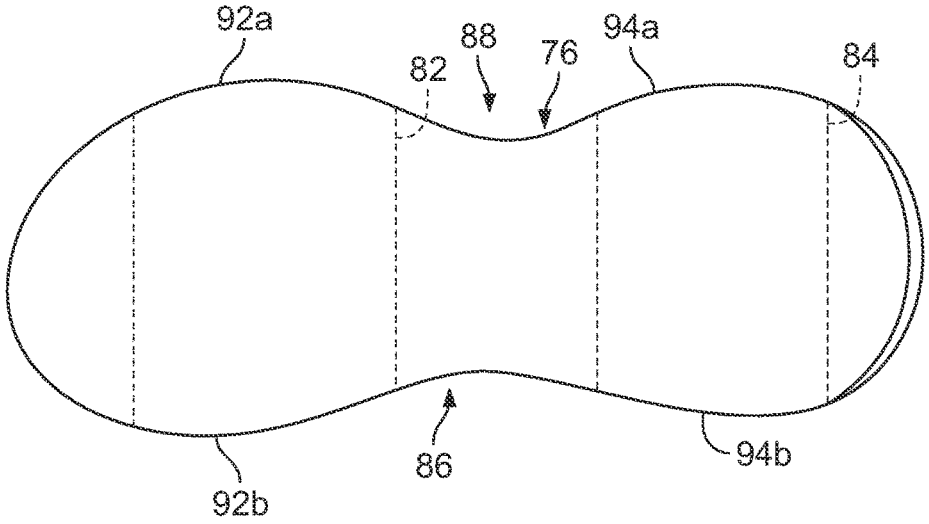
FIG. 8 is a top view of the article of footwear of FIG. 7 with the support members removed from the sole.
Figure 9:
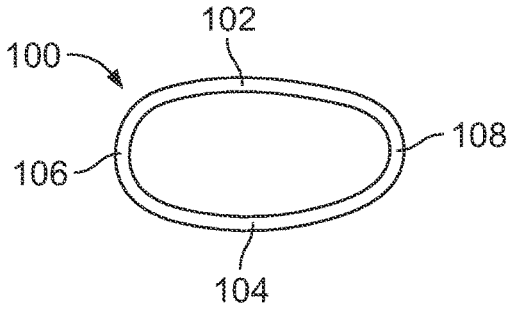
FIG. 9 is an elevational view of the rear support member shown in FIG. 7.
Figure 10:
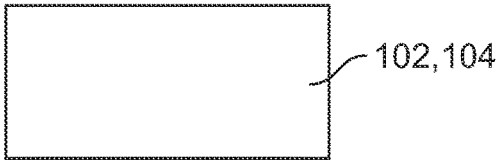
FIG. 10 is a top view of the rear support member of FIG. 9, wherein the bottom view is a mirror image thereof.
Figure 11:
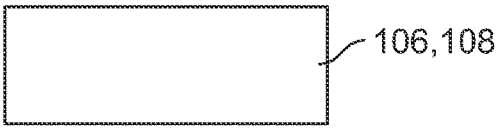
FIG. 11 is a front view of the rear support member of FIG. 9, wherein the rear view is a mirror image thereof.

Referring now to FIGS. 7-11, in another embodiment, an article of footwear generally indicated as 74, includes a sole 76 having a midsole 78 and an outsole 80 as described above, where the midsole 78 includes a first through-hole 82 in the forefoot area of the sole 76 and a second through-hole 84 in the heel area of the sole 76. As shown in FIG. 8, the first through-hole 82 and the second through-hole 84 extend between the medial side 86 and the lateral side 88 of the sole 76 such that both ends 90*a*, 90*b* of the first through-hole 82 and both ends 92*a*, 92*b* of the second through-hole 84 are open or exposed to the environment on the outer surface of the sole 76. Alternatively, one or both ends 90*a*, 90*b* of the first through-hole 82 and/or one or both ends 92*a*, 92*b* of the second through-hole 84 are closed by a portion of the sole 76.

In the illustrated embodiment, a first support member 94 is positioned in the first through-hole 82 and is configured with a first spring member 96 and a second spring member 98 as shown in FIGS. 3-6 and described above. A second support member 100 is positioned in the second through-hole 84 to provide support and resiliency to the heel area of the sole 76. As shown in FIGS. 7 and 9-11, the second support member 100 is formed as an integral unit and includes an upper plate 102 and a lower plate 104 interconnected by a front end member 106 and a rear end member 108. During movement, the second support member 100 supports a user's heel and compresses as the heel of the article of footwear 74 contacts the ground. In an embodiment, the second support member 100 has a uniform level of rigidity and resiliency or compressibility. In another embodiment, the second support member 100 is configured so that different portions of the second support member have different levels of rigidity and/or compressibility. The differences in rigidity and compressibility may be achieved by adjusting the length, width and/or thickness of the second support member 100, adjusting the distance between the upper plate 102 and the lower plate 104, and/or using different materials to form the second support member 100.

It should be appreciated that the second support member 100 may be made of metal, rubber, a composite material or any suitable material or combination of materials.

Figure 12:
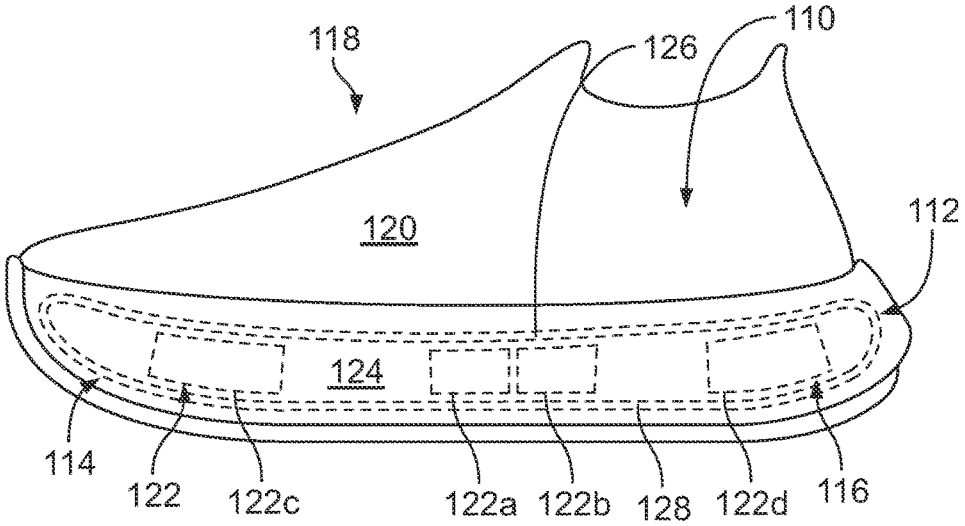
FIG. 12 is an elevational view of an article of footwear including another embodiment of the present sole.
Figure 13:
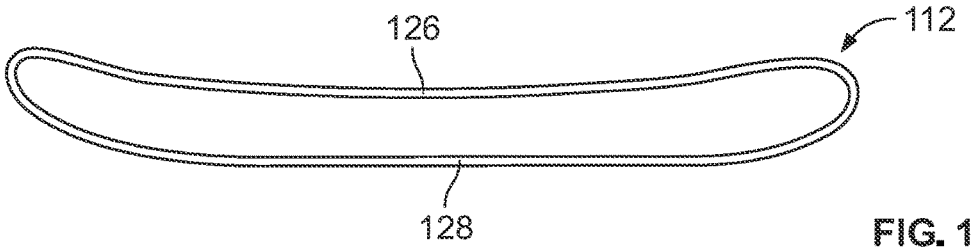
FIG. 13 is an elevational view of an embodiment of the support member within the sole shown in FIG. 12.
Figure 14:
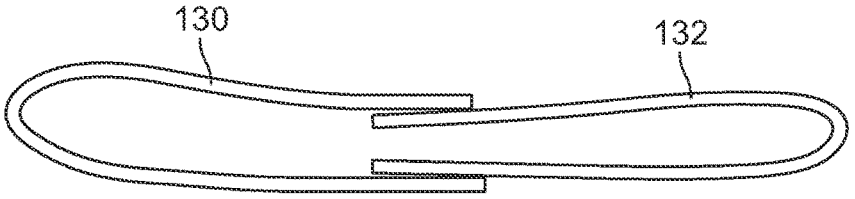
FIG. 14 is an elevational view of another embodiment of the support member within the sole shown in FIG. 12.

Referring to FIGS. 12-14, another embodiment of the present sole generally indicated as 110 is provided, where the sole 110 may be an integral unit formed with one or more materials as shown in FIG. 12 or include a midsole and an outsole attached to the midsole as described above. In this embodiment, an elongated support member 112 is embedded in or molded in the sole 110 and extends from the toe area 114 to the heel area 116 of the sole 110. It should be appreciated that the support member 112 may be any suitable length based on the desired area or areas of the sole in which support is needed. Similarly, the support member 112 may have a width that extends between the medial side 118 and the lateral side 120 of the sole 110 or may have a width that is less than the width defined between the medial and lateral sides. In the illustrated embodiment, the support member 112 is an integral unit as shown in FIG. 13 that is formed or made preferably with a carbon-based fiber material. The support member 112 may also be made of a metal, a composite material or by any suitable material or combination of materials.

To adjust the level of rigidity and compressibility of the support member 112, at least one cushion member 122 and preferably a plurality of cushion members 122 are positioned within the space 124 defined between an upper plate 126 and a lower plate 128 of the support member 112. In the embodiment shown in FIG. 12, a plurality of the cushion members 122 are positioned in the space 124 at different positions along the length of the support member 112. The cushion members 122 may be positioned next to each other as with cushion members 122*a* and 122*b*, or may be spaced apart from each other as with cushion members 122*c* and 122*a* or 122*b* and 122*d*. The cushion members 122 provide increased support and rigidity at the different positions along the length of the support member 112 and enable the rigidity and compressibility of the support member to be adjusted at different locations along the length of the sole 110. Each cushion member 122 is preferably made of a foam material but may also be made with any suitable material or combination of materials. It should be appreciated that in another embodiment, the support member 112 may include a first spring member 130 and a separate, second spring member 132 as shown in FIG. 14 similar to the support member 46 shown in FIG. 3 and described above.

Figure 15:
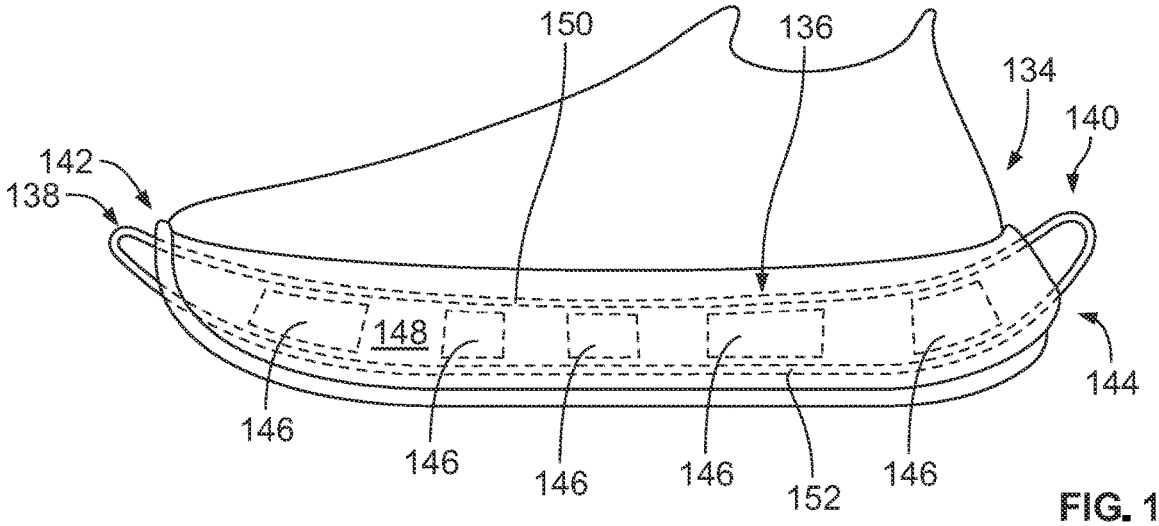
FIG. 15 is an elevational view of an article of footwear including a further embodiment of the present sole.

Referring now to FIG. 15, another embodiment of the present sole generally indicated as 134 is shown and includes a support member 136 that is similar to the support member 112 shown in FIG. 12 except that the ends 138, 140 of the support member 134 extend from the front end 142 and the rear end 144 of the sole 134. In this embodiment, the support member 136 may be provided in an open area or compartment defined within the sole 134 or embedded in or molded within the sole 134. In the illustrated embodiment, the support member 134 extends a designated distance from the front end 142 of the sole and a designated distance from the rear end 144 of the sole where the distance that the support member 134 extends from the front end 142 of the sole may be the same or different from the distance that the support member 134 extends from the rear end 144 of the sole. In this embodiment, at least one cushion member and preferably a plurality of cushion members 146 are positioned in the space 148 defined between the upper plate 150 and the lower plate 152 of the support member 136. As described above, two or more of the cushion members 146 may be located adjacent to each other or spaced from each other, along the length of the support member 136. Each cushion member 146 is preferably made of a foam material, but may also be made with an elastomeric polymer, such as Ethylene Vinyl Acetate (EVA), or any suitable material or combination of materials. The cushion members 146 are used to adjust the rigidity and compressibility of the support member 136 at different locations along the length of the support member. Further, the support member 136 may be an integral unit as shown in FIG. 13 or made of a plurality of spring members as shown in FIG. 14.

Figure 16:
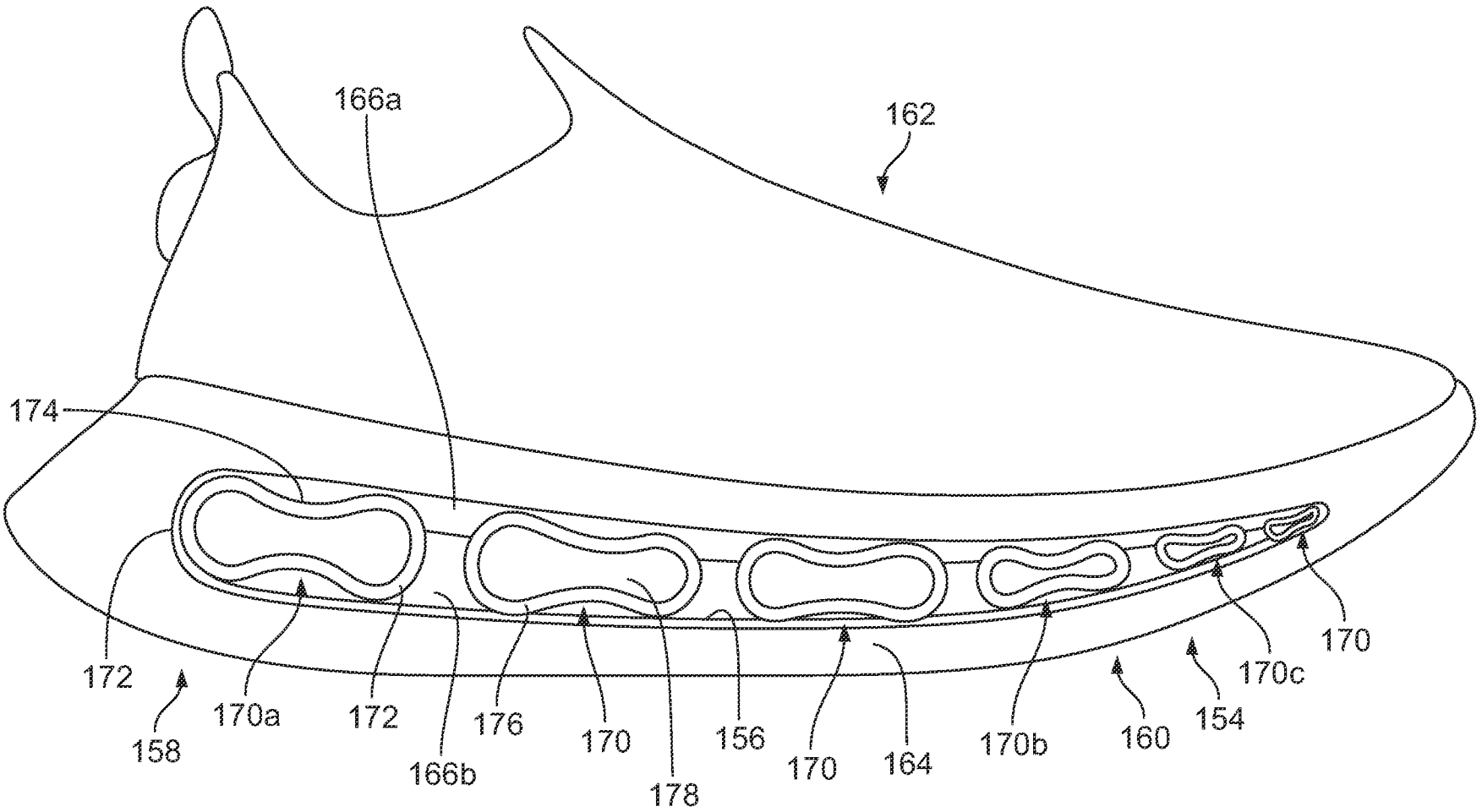
FIG. 16 is an elevational view of an article of footwear including another embodiment of the present sole.

Referring now to FIG. 16, another embodiment of the present sole generally indicated as 154 is shown where the sole includes a through-hole 156 that extends from the heel area 158 to the forefoot area 160 of the sole 154. In this embodiment, the through-hole 156 extends between the medial side 162 and the lateral side 164 of the sole 154. In another embodiment, one side or both sides 166*a*, 166*b* of the through-hole 156 are closed by a portion 168 of the sole 154. In this embodiment, a plurality of support members 170 are positioned within the through-hole 156 in the sole 154. Each of the support members 170 have rounded ends 172 connected by a substantially straight middle portion 174. The rounded ends 172 may be the same size and shape as in support member 170*a* or may have a different size and shape as in support members 170*b* and 170*c*. As shown in FIG. 16, the support members 170 are positioned end-to-end along the length of the through-hole 156 in the sole 154 and provide different levels of rigidity and compressibility along the length of the sole. In the illustrated embodiment, the support members 170 are each made with a single material, such as a foam material or EVA. In another embodiment, the support members 170 each include a peripheral layer 176 made with a first material, such as a metal or composite material, and the internal area 178 of the support members is made with a foam material. It should be appreciated that the support members 170 may be any suitable size and shape and may be made with any suitable material or combination of materials. It should also be appreciated that the internal area 178 of one or more of the support members 170 may be hollow, i.e., no material or materials filled within the space defined by the peripheral layer 176.

Figure 17:
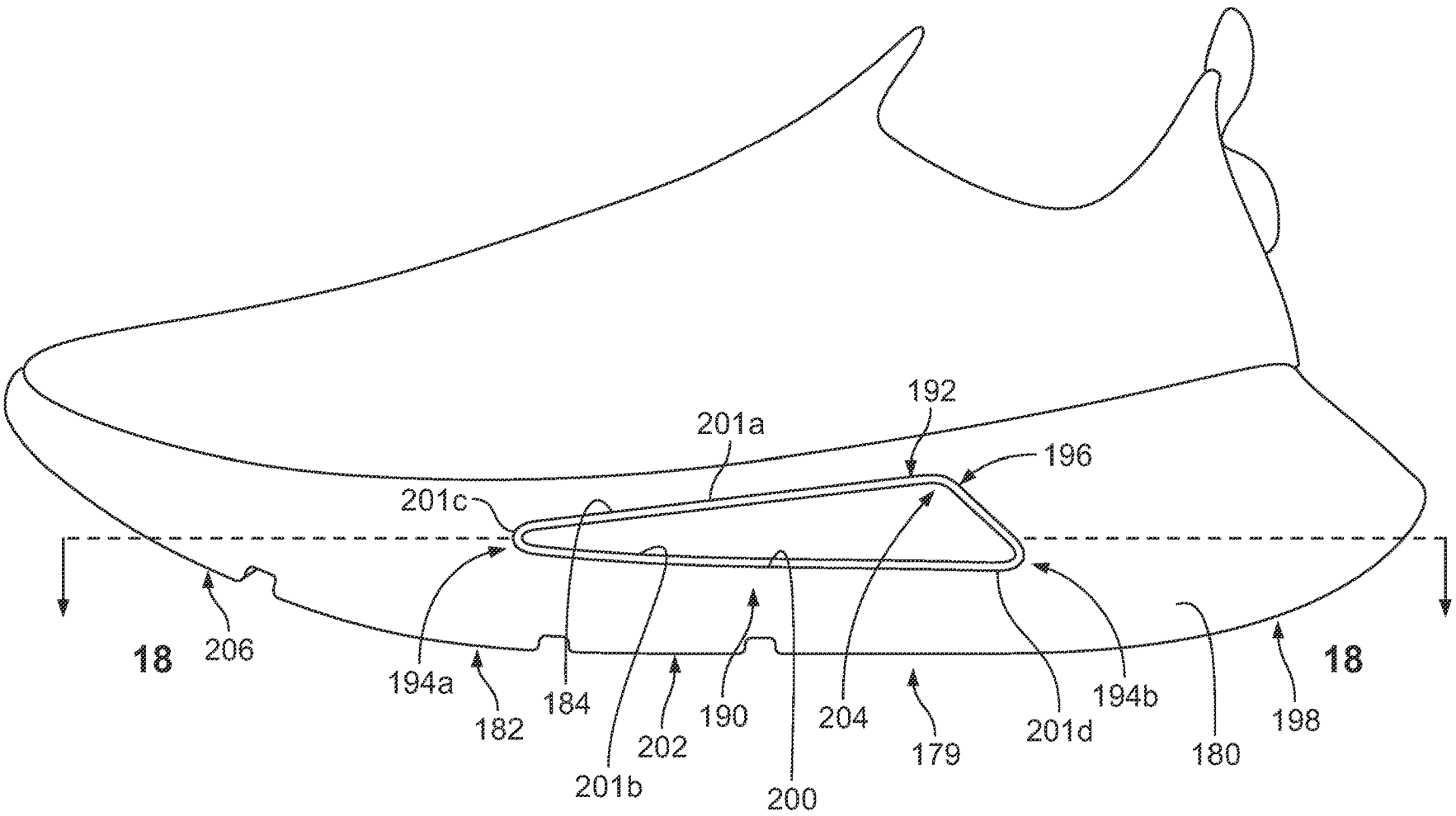
FIG. 17 is an elevational view of an article of footwear including a further embodiment of the present sole.
Figure 18:
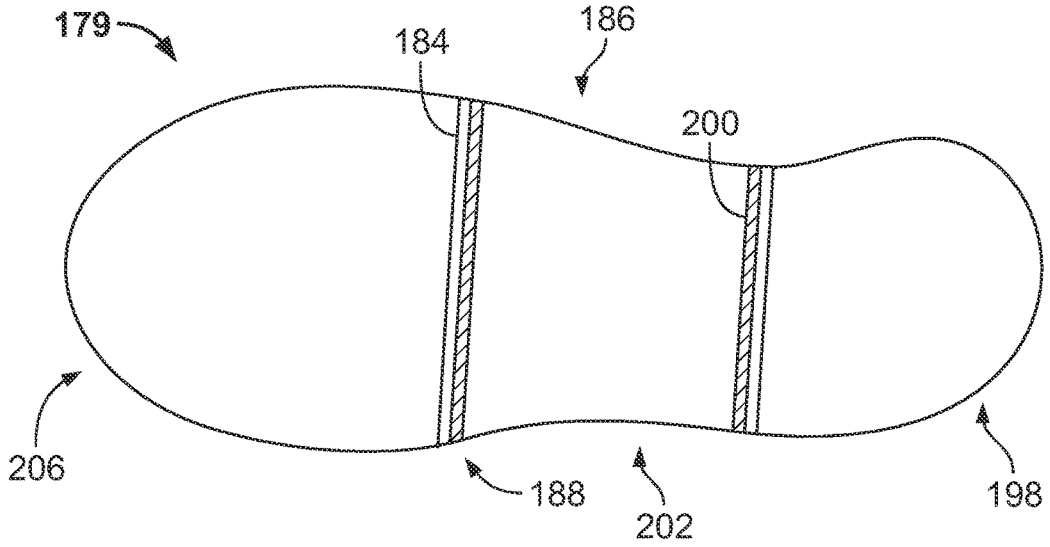
FIG. 18 is a cross-section view taken generally along the line 18-18 in FIG. 17 in the direction generally indicated.
Figure 19A:
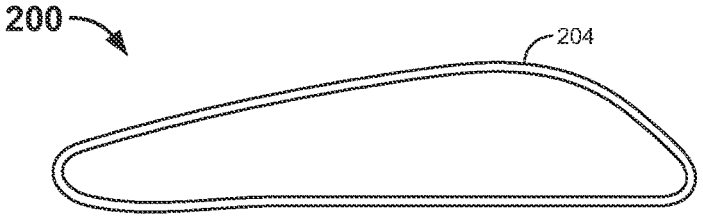
FIG. 19A is a side view of the support member shown in FIG. 17.
Figure 19B:
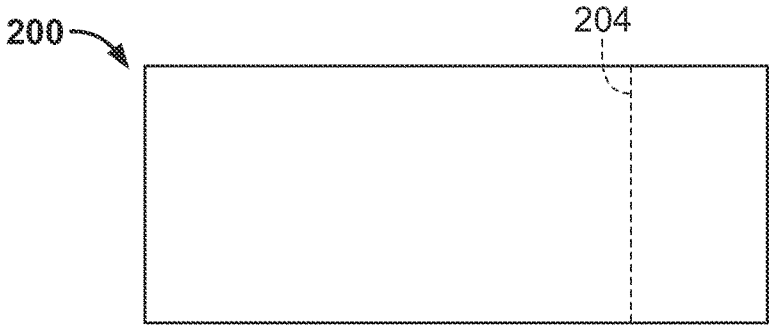
FIG. 19B is a top view of the support member of FIG. 19A.
Figure 19C:
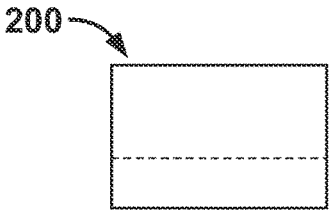
FIG. 19C is a front view of the support member of FIG. 19A.
Figure 19D:
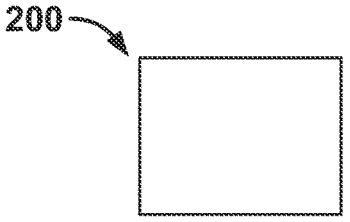
FIG. 19D is a rear view of the support member of FIG. 19A.

Referring now to FIGS. 17 to 19D, an article of footwear is provided that includes another embodiment of the sole 179, where the sole includes a midsole 180 made of the material or materials described above, and an outsole 182 attached to the midsole. As shown in FIG. 17, a through-hole 184 having a triangular shape is formed in the sole 178 and extends from the medial side 186 to the lateral side 188 of the sole. The through-hole 184 is formed by a substantially flat bottom wall 190, an angled top wall 192 and end walls 194*a* and 194*b* extending between the top wall 192 and the bottom wall 190. In the illustrated embodiment, the first end wall 194*a* has a curved shape and the second end wall 194*b* is angled between the top wall 192 and the bottom wall 190. More specifically, the through-hole 184 is formed in the sole 179 so that the bottom of the through-hole is substantially flat and the peak 196 of the through-hole 184 is positioned adjacent to or at least partially in the heel area 198 of the sole 179. The peak 196 of the through-hole 184 is the initial compression point when a user's foot presses downwardly on the top wall 192 during use.

A support member 200 having a top wall 201*a*, a bottom wall 201*b* and opposing end walls 201*c* and 201*d* forming a triangular shape, which corresponds to the shape of the through-hole 184, is placed within the through-hole and secured in position by an adhesive or other suitable attachment method. The support member 200 is preferably made of a carbon-fiber based material, but may be made of any suitable material or combination of materials. In the illustrated embodiment, the support member 200 is an integral unit formed by injection molding or compression molding. In another embodiment, the support member 200 is made of two components that are positioned adjacent to each other or that are secured together by an adhesive, heat compression or other attachment method. The support member 200 preferably has a thickness of 2.0 μm, but may have any suitable thickness. As stated above, the peak 196 of the through-hole 184 and thereby the support member 200 is located adjacent to or at least partially in the heel area 198. Positioning the peak 196 of the triangular shape off center and closer to the heel area 198 causes a user's foot to be propelled forward upon rebound of the support member 200 when pressure is released from the support member by a user's foot. It is contemplated that the respective peaks of the through-hole and the support member may be in the midfoot area 202, or other suitable area relative to the sole 179.

While walking or running, a user's foot will press downward on the peak 204 of the support member 200 when the heel of the shoe contacts an underlying surface such as the ground. The user's foot will continue to press downwardly on the support member 200 until the user's foot rocks toward the toe area 206 of the sole 179. As pressure is released on the support member 200, the support member will return to its initial non-compressed position shown in FIG. 17. In this way, the support member 200 provides more support to a particular area of a user's foot while in use to enhance stability to that area of the foot and reduce fatigue. Further, the through-hole 184 formed in the sole 179 reduces the material in the sole thereby making the shoe lighter in weight, which also reduces fatigue.

Referring now to FIGS. 20 to 23C, another embodiment of the sole 208 is shown and includes an upper midsole 210 made of a first material and a lower midsole 212 made of a second material, where the first material and the second material may be the same material or different materials. For example, the upper midsole 210 is preferably made of Ethylene-vinyl acetate (EVA) having a first hardness value and the lower midsole 212 is made of an EVA having a second hardness value, where the first and second hardness values are different. In an embodiment, the first hardness value of the upper midsole 210 is less than the second hardness value of the lower midsole 212 to provide cushioning and support to a user's foot while providing stability and balance on even and uneven ground. Also, the upper midsole 210 is molded to have an outer peripheral wall 214 that defines a recessed area 216 for receiving a user's foot and minimizing lateral movement of the user's foot within the upper midsole 210. The upper and lower midsoles 210, 212 may be attached together by using an adhesive, co-molded together, compression or press molded together or attached together using any suitable attachment method. An outsole 218 is attached to a bottom surface 220 of the lower midsole 212 and preferably has a plurality of tread members 222 made of rubber or other suitable materials, and configured to grip an underlying surface during use.

Figure 20:
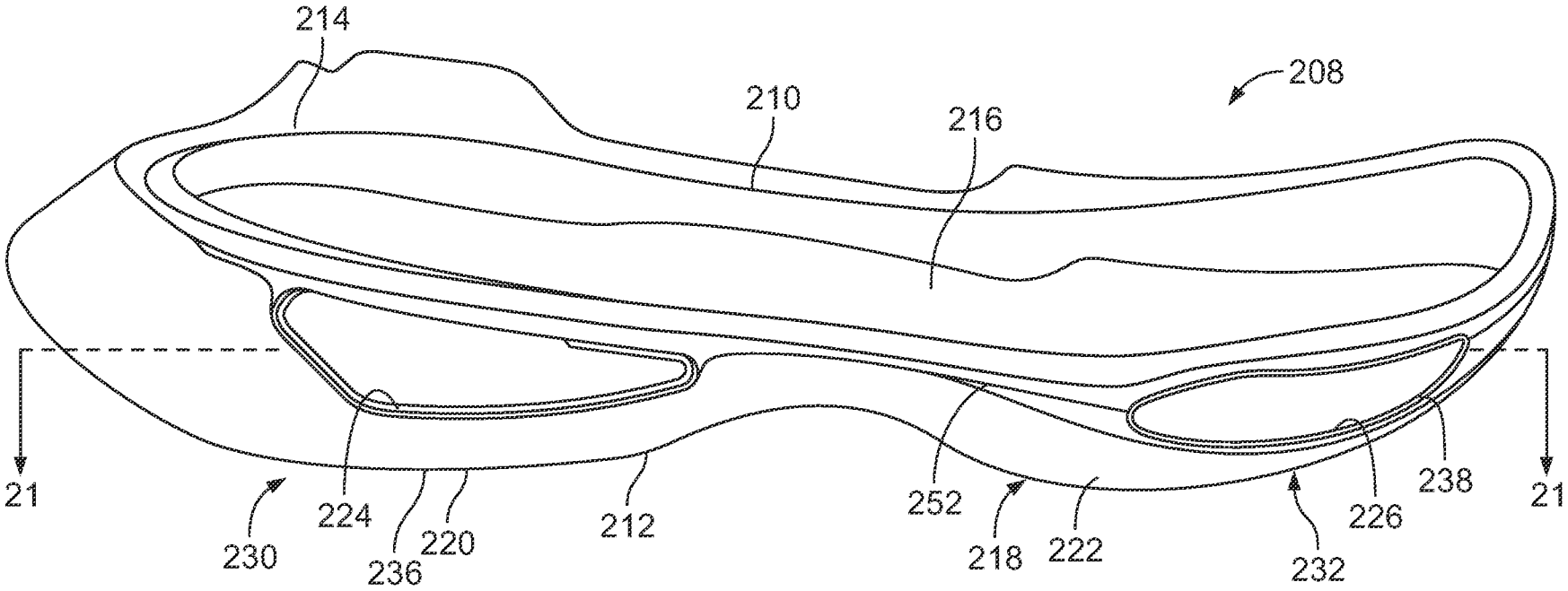
FIG. 20 is an elevational view of another embodiment of the sole in which the sole includes two support members.
Figure 21:
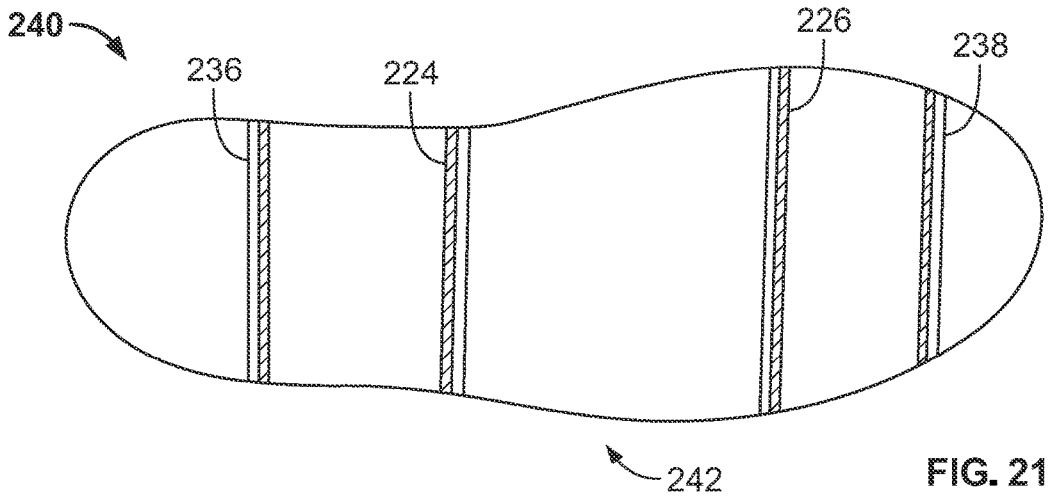
FIG. 21 is a cross-section view taken generally along the line 21-21 in FIG. 20 in the direction generally indicated.
Figure 22A:
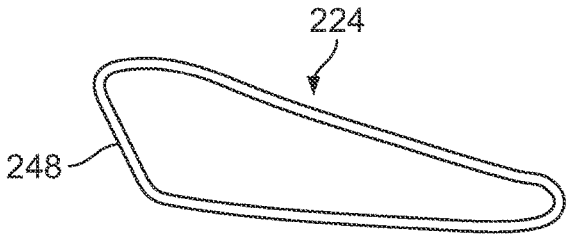
FIG. 22A is a side view of the first support member shown in FIG. 20.
Figure 23A:
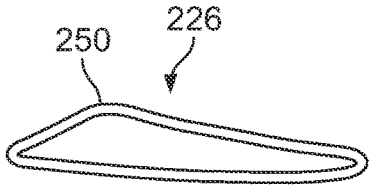
FIG. 23A is a side view of the second support member shown in FIG. 20.
Figure 22B:
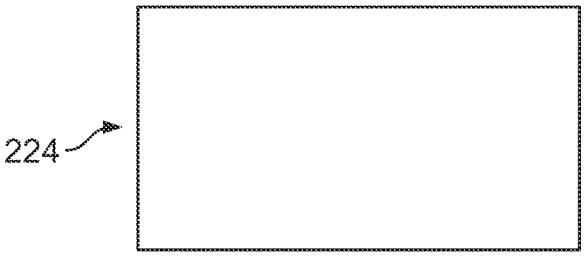
FIG. 22B is a top view of the support member of FIG. 22A, where the bottom view is a mirror image thereof.
Figure 23B:
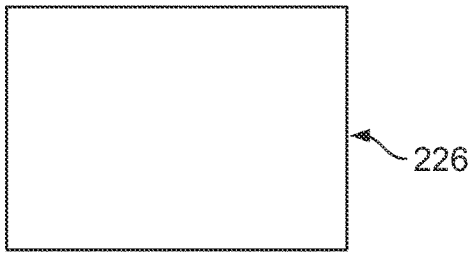
FIG. 23B is a top view of the support member of FIG. 23A, where the bottom view is a mirror image thereof.
Figure 22C:
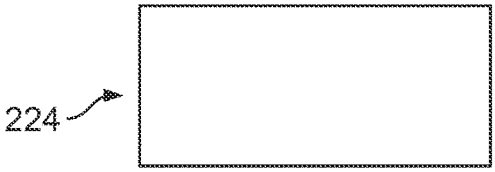
FIG. 22C is a front view of the support member of FIG. 22A, where the rear view is a mirror image thereof.
Figure 23C:
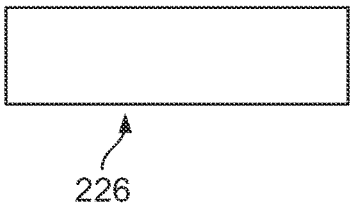
FIG. 23C is a front view of the support member of FIG. 23A, where the rear view is a mirror image thereof.

As shown in FIG. 20, the sole 208 includes two support members 224, 226 positioned at different locations within the sole. In this embodiment, the peripheral wall 214 extends about a periphery of the sole where a portion of the peripheral wall 214 in the heel area 230 and the forefoot area 232 has a height that is greater than a height of the remaining portions of the peripheral wall. The peripheral wall 214 forms the recessed area 216 for receiving an upper (not shown) and helps to limit lateral movement of a user's foot during use. In the illustrated embodiment, a first through-hole 236 is formed in the heel area 230 of the sole 208 and a second through-hole 238 is formed in the forefoot area 232 of the sole 208 where the first through-hole 236 and the second through-hole 238 each extend from a medial side 240 to a lateral side 242 of the sole as shown in FIG. 21. In another embodiment, one end of one or both of the first and second through-holes 236, 238 is closed by a wall of the sole 208. In a further embodiment, both ends of the first and second through-holes 236, 238 are closed by a wall of the sole 208 such that the first and second through-holes form internal chambers within the sole.

As shown in FIGS. 20 and 22A to 23C, the first and second support members 224, 226 are respectively inserted in the first and second through-holes 236, 238. In this embodiment, the first and second support members 224, 226 may be attached to the sole 208 using an adhesive or integrally formed with the sole 208. The first support member 224 and the first through-hole 236 each have a triangular, non-symmetrical shape where a peak 248 of the first support member 224 is pointed toward the outsole 218. The second support member 226 and the second through-hole 238 also each have a triangular, non-symmetrical shape where the peak 250 of the second support member 226 point toward the lower surface 252 of the upper midsole 210. Further, the first support member 224 has a size that is greater than a size of the second support member 226. It should be appreciated that the first and second support members 224, 226 and the first and second through-holes 236, 238 may have the same shape or different shapes. Additionally, the peaks 248, 250 of the first and second support members 224, 226 may point in different directions as shown in FIG. 20, or in the same direction. The configuration or shape, and the sizes of the first and second support members 224, 226 and the first and second through-holes 236, 238 are determined based on the desired support and cushioning in the different areas of the shoe. It should be appreciated that the first and second support members 224, 226 and the first and second through-holes 236, 238 are not limited to the heel area 230 and the forefoot area 232 of the sole 208, and may be located in any suitable areas of the sole 208.

Figure 24:
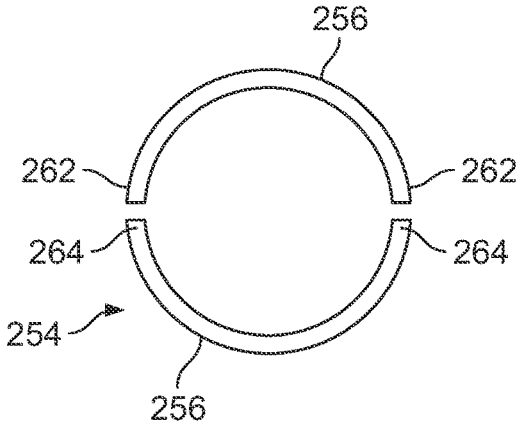
FIG. 24 is an elevational view of another embodiment of the support member.
Figure 25:
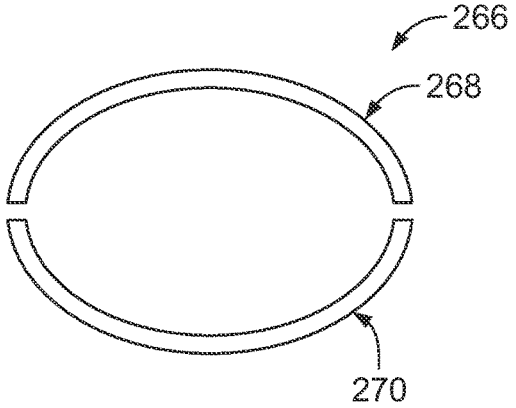
FIG. 25 is an elevational view of a further embodiment of the support member.
Figure 26:
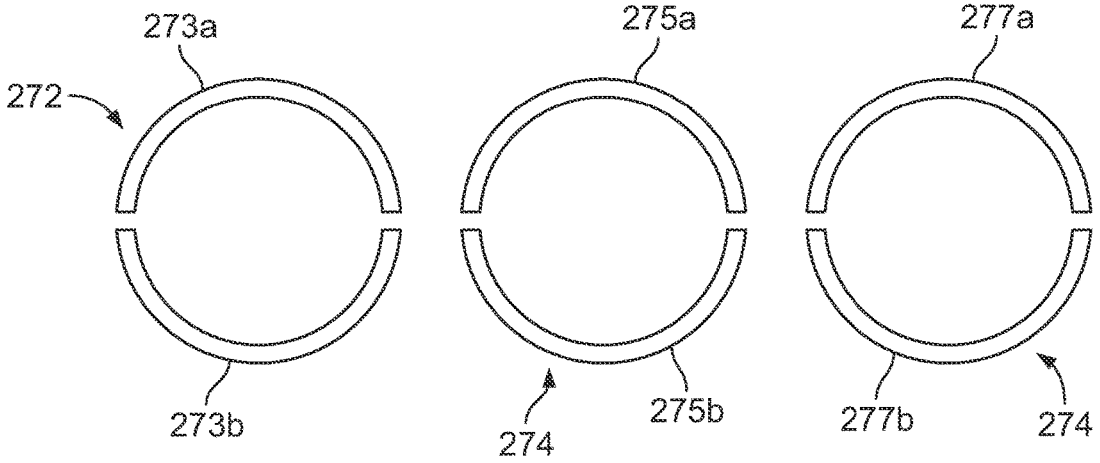
FIG. 26 is an elevational view of an embodiment that includes a plurality of support members.

Referring now to FIGS. 24 to 26, additional embodiments of the support member are shown and are configured to provide different levels of support and cushioning within the sole. The support member 254 shown in FIG. 24 includes a first or upper support 256 and a second or lower support 258 that each have a C-shape. The upper and lower supports 256, 258 are positioned within a through-hole formed in a sole as described above so that ends 262, 264 of the upper and lower supports 256, 258 are positioned adjacent to and are in contact with each other. In this embodiment, the upper and lower supports 256, 258 are made with a carbon fiber-based material but may be made with any suitable material or combination of materials. Further, the upper and lower supports 256, 258 may be made with the same material or different materials and also may be made to be the same size, such as having the same length and thickness, or different sizes. In another embodiment, the upper and lower supports 256, 258 are made as separate components and then joined together by adhesive or molding.

Referring to FIG. 25, another embodiment of the support member shown in FIG. 24 is illustrated where the support member 266 has upper and lower supports 268, 270 have a C-shape and are elongated to have a different length than the upper and lower supports 256, 258 shown in FIG. 24. The different lengths of the upper and lower supports 268, 270 adjusts the compressibility of the support member 266 and also expands the area within the sole that is supported by the support member. As stated above, the upper and lower supports 268, 270 may be any suitable size and shape based on the desired levels of support and cushioning for the sole.

Referring to FIG. 26, a further embodiment shows a plurality of support members 272, 274 and 276 having the configuration of the support member 254 of FIG. 24, that are positioned adjacent to each other within a through-hole in a sole. In this embodiment, the upper and lower supports 273*a*, 273*b*, 275*a*, 275*b*, 277*a* and 277*b* are each made with the same material and have the same general size and shape. In another embodiment, the upper and lower supports 273*a*, 273*b*, 275*a*, 275*b*, 277*a* and 277*b* of each of the support members 272, 274 and 276 are made with the same material and have the same size and shape. It should be appreciated that the upper and lower support members of one or more of the support members 272, 274 and 276 may be made with different materials and or with a different size and shape than the upper and lower supports in one or more of the other support members. It should be appreciated that the upper and lower supports 273*a*, 273*b*, 275*a*, 275*b*, 277*a* and 277*b* may be made with different materials and may all have a different size and shape.

Figure 27:
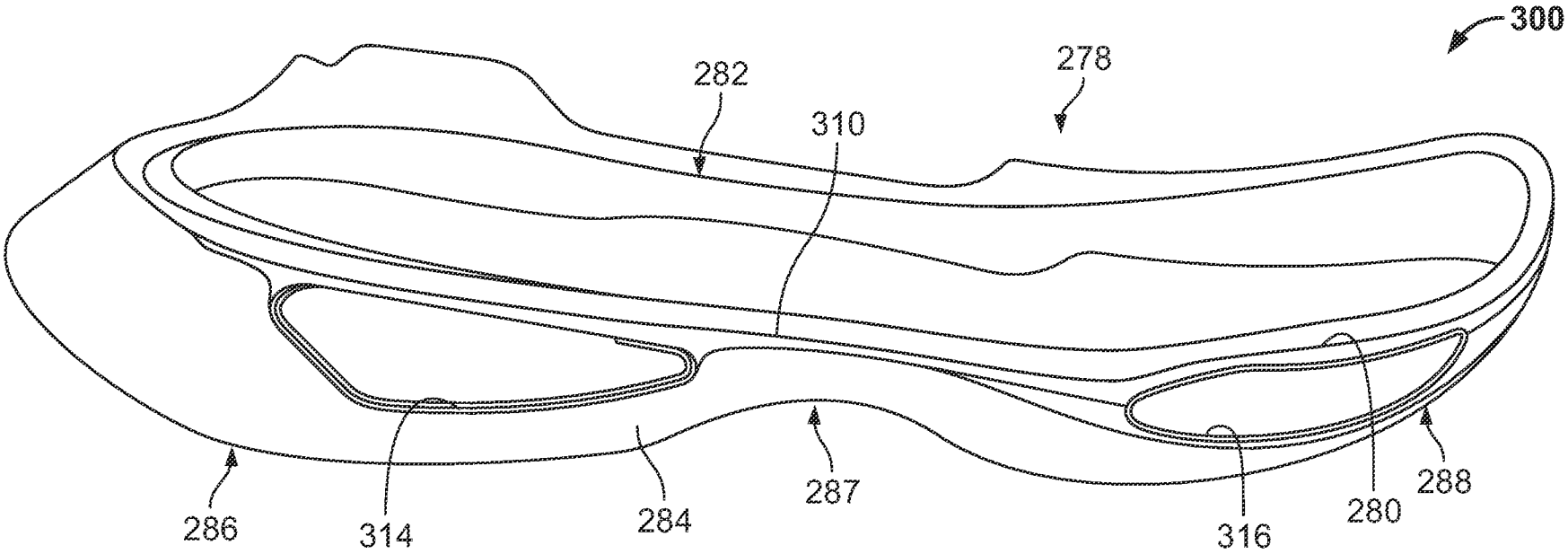
FIG. 27 is an elevational view of another embodiment of the sole in which the sole includes support members and a support plate.
Figure 28A:
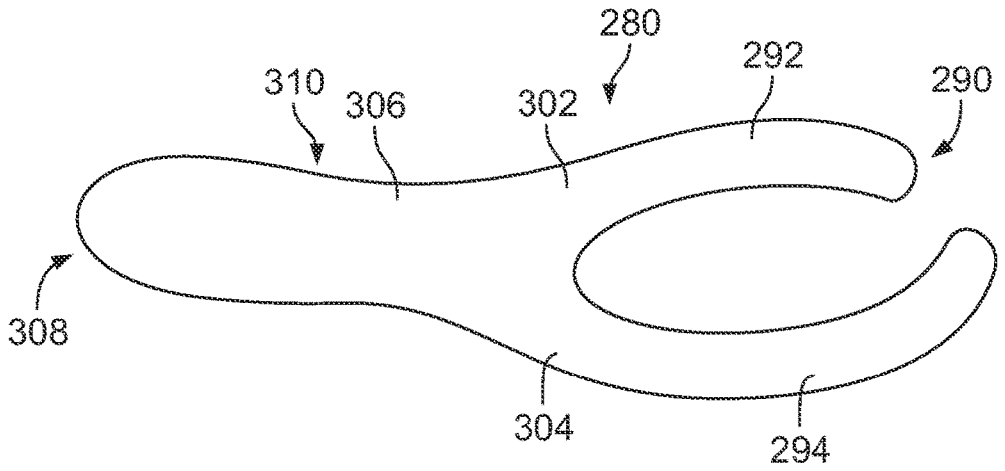
FIG. 28A is a top view of the support plate shown in FIG. 27.
Figure 28B:
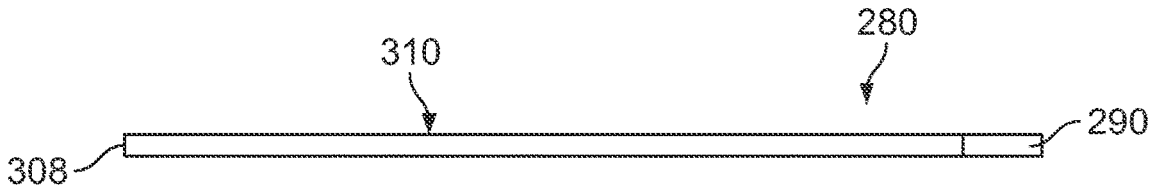
FIG. 28B is a left side view of the support plate of FIG. 28A.
Figure 28C:
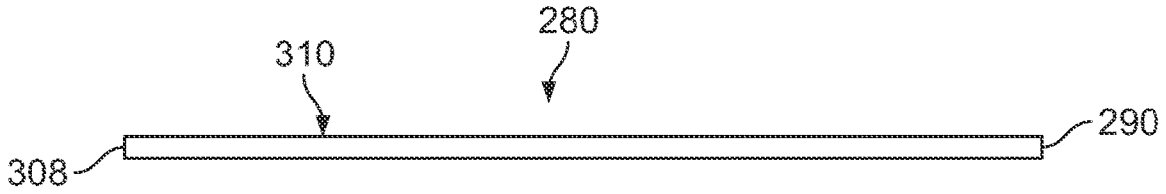
FIG. 28C is a right side view of the support plate of FIG. 28A.
Figure 28D:
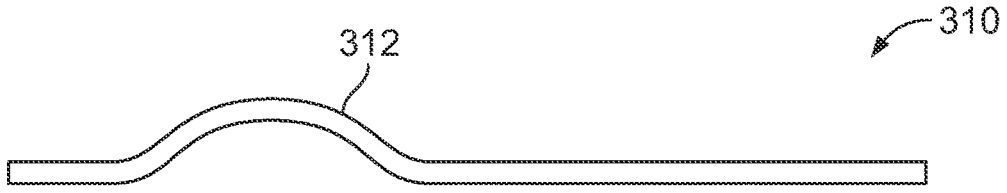
FIG. 28D is another embodiment of the support plate in which the support plate includes a convex portion.
Figure 29:
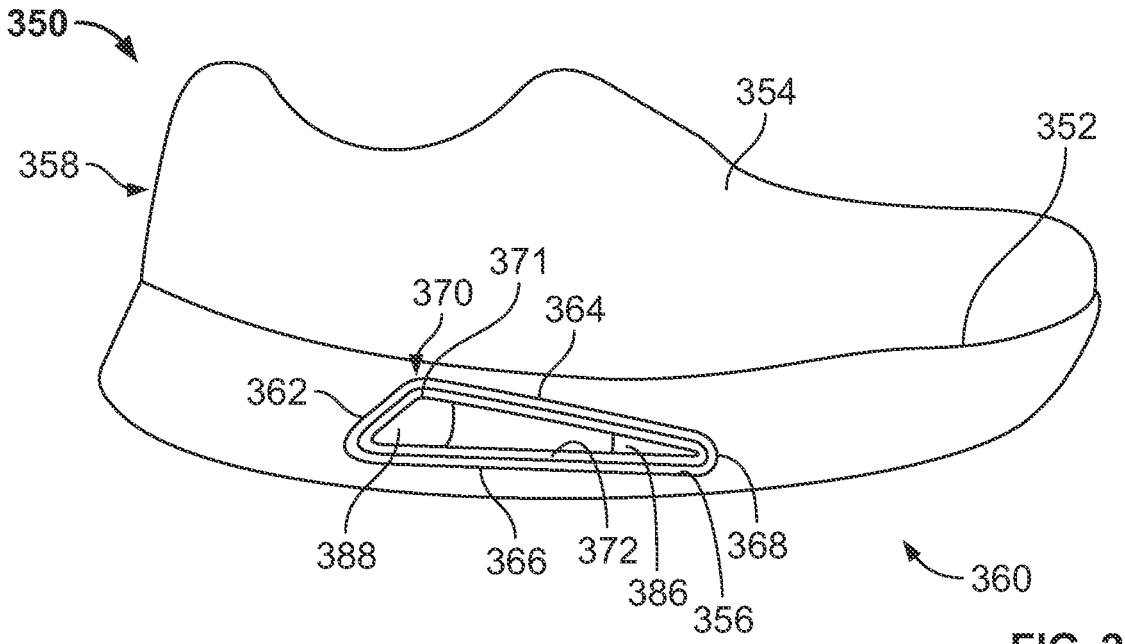
FIG. 29 is an elevational view of a further embodiment of the sole in which the sole includes a support member.
Figure 30:
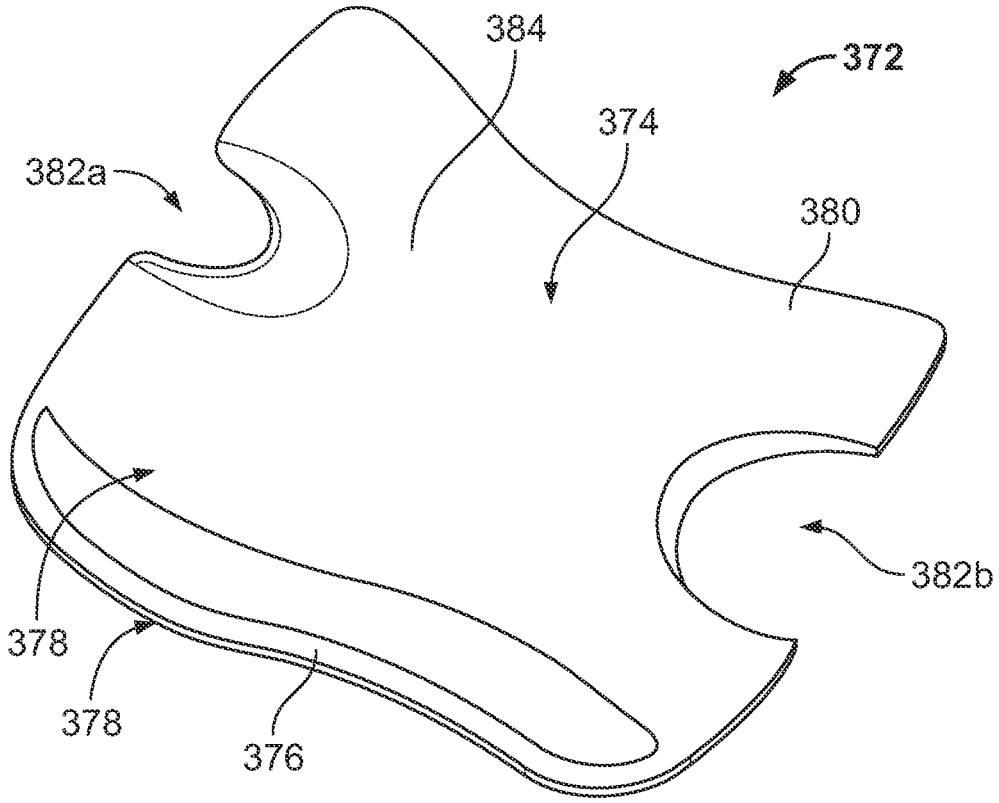
FIG. 30 is a perspective view of the support member of FIG. 29.
Figure 31:
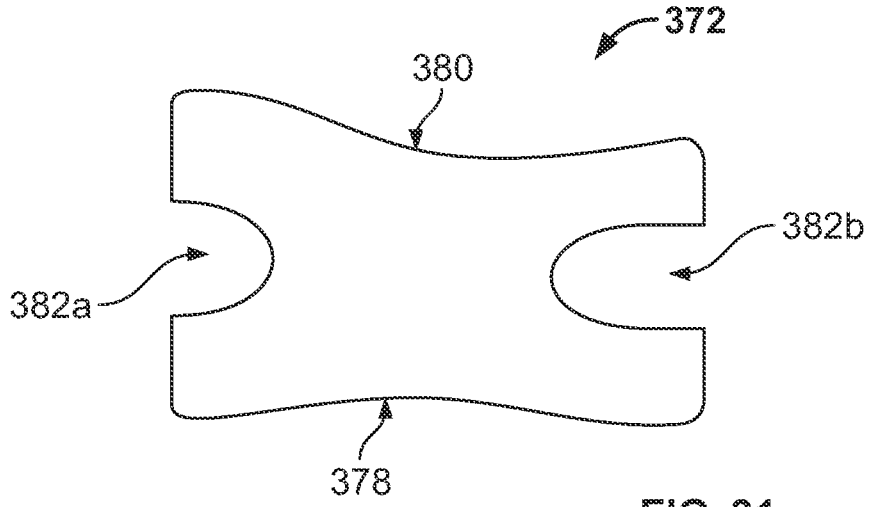
FIG. 31 is a top view of the support member of FIG. 30.
Figure 32:
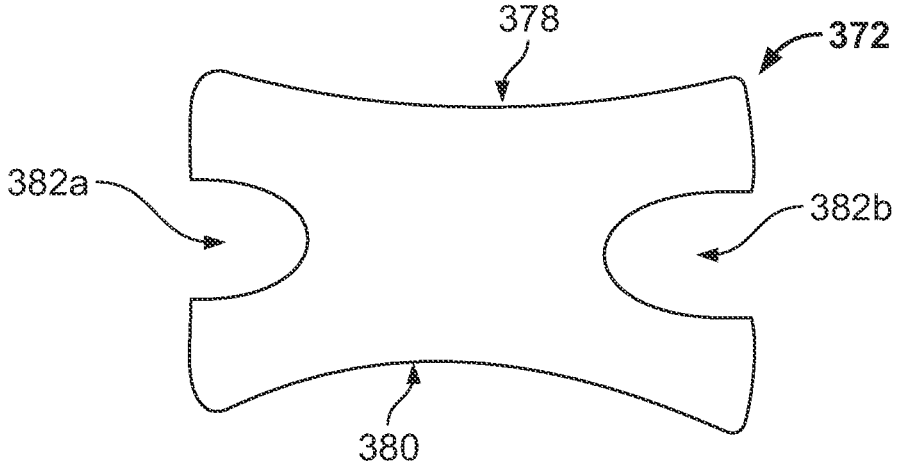
FIG. 32 is a bottom view of the support member of FIG. 30.
Figure 33:
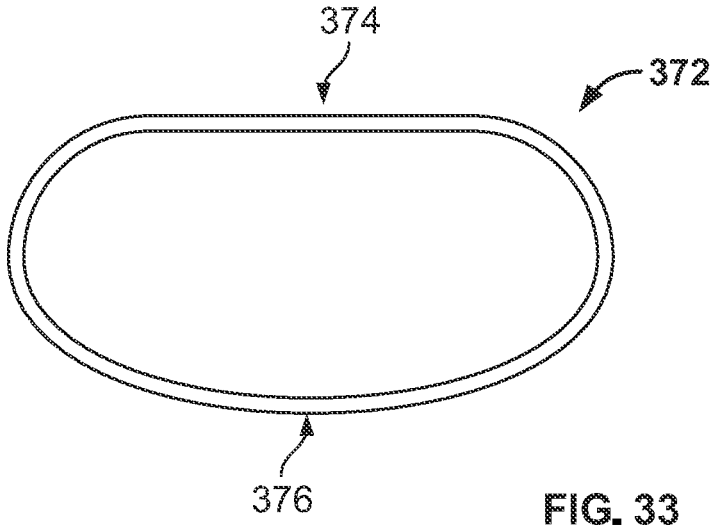
FIG. 33 is a right side view of the support member of FIG. 30, where the left side view is a mirror image thereof.
Figure 34:
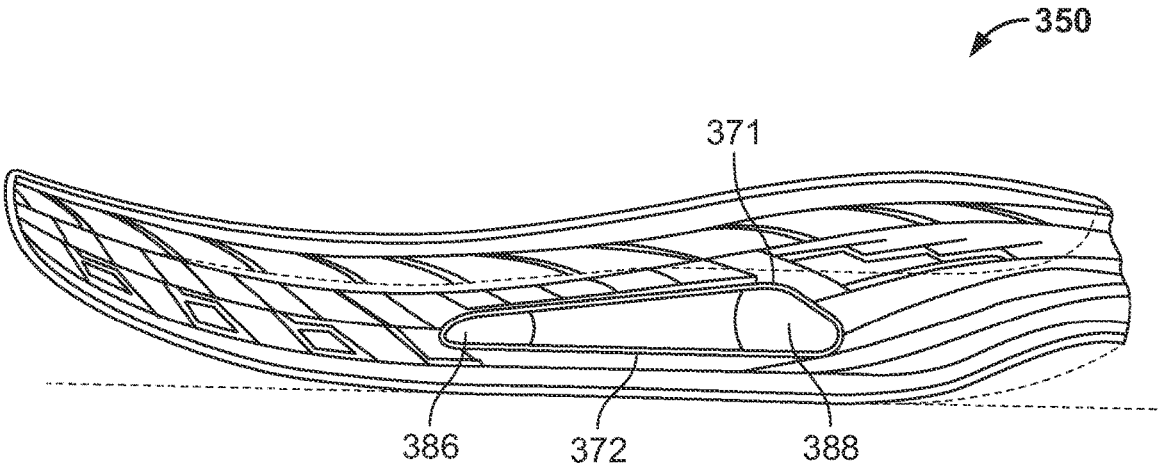
FIG. 34 is a left side view of the sole of FIG. 29.
Figure 35:
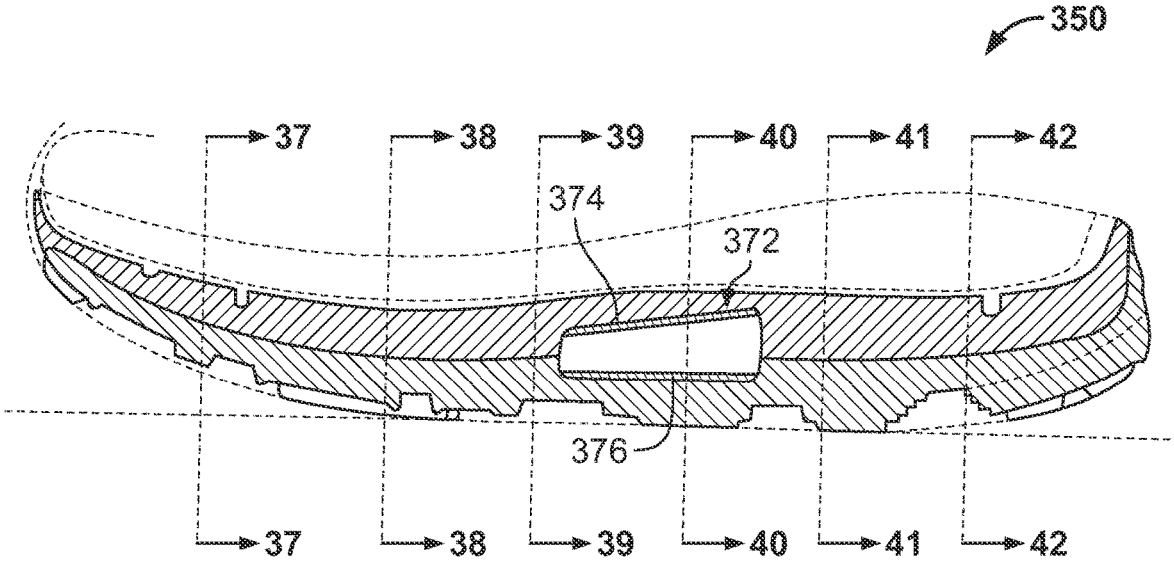
FIG. 35 is a cross-section view taken generally along the line 35-35 in FIG. 36 in the direction generally indicated.

Referring now to FIGS. 27 to 28D, another embodiment of the present sole 278 is illustrated and has the same structure as sole shown in FIG. 20 with the addition of support member or support plate 280 that is positioned between the upper midsole 282 and the lower midsole 284. The support plate 280 may be secured to the upper midsole 282, the lower midsole 284 or both the upper midsole and the lower midsole by adhesive or molded to the upper and lower midsoles by compression molding or injection molding. As shown in FIG. 27, the support plate 280 extends from the heel area 286 to at least partially into the forefoot area 288 of the sole 278. It should be appreciated that the support plate 280 may have any suitable length and be positioned in the heel area 286, the midfoot area 287, the forefoot area 288 or any suitable area or areas of the sole 278.

As shown in FIGS. 28A to 28C, the support plate 280 has a front end 290 with a medial arm 292 and a lateral arm 294, where the medial arm 292 extends from the midfoot area 287 to the forefoot area 288 of the sole 278 and along a medial side of the sole 278 and has a length that is less than a length of the lateral arm 294. The lateral arm 294 extends from the midfoot area 287 to the forefoot area 288 and along the lateral side of the sole 278. As shown, the lateral arm 294 curves into a toe area 300 of the sole 278 and in a direction toward the medial arm 292. The rear ends 302, 304 of the medial arm 292 and the lateral arm 294 join at a central part 306 of the support plate 280 that extends from the medial arm 292 and the lateral arm 294 to a rear end 308 of the support plate 280. The rear end 308 of the support plate 280 extends from the central part 306 and at least partially into the heel area 286 of the sole 278. In this embodiment, the support plate 280 is made of a carbon fiber-based material. The support plate 280 may also be made of EVA or any suitable material or combination of materials. FIG. 28D shows another embodiment of the support plate 310 in which a portion of the support plate is located in the heel area 286 of the sole and has a convex portion 312 that flexes downward from an initial non-compressed position when pressure is applied by a user's foot and then flexes upward to the non-compressed position when pressure is released from the convex portion. The convex portion 312 of the support plate 280 provides additional support to the user's foot during use.

The support plate 280 is combined with support members 314, 316 shown in FIG. 27 provides enhanced support and propulsion to a user's foot during use. In the heel area 286 of the sole 278, the support plate 280 provides rigidity to the upper midsole 282 while one or both of the support members 314, 316 compresses upon impact by the heel of the sole 278 with the ground and then helps to propel the user's foot toward the forefoot area 288 of the sole 278 as pressure is released on the support plate 280 and the support members 314, 316. In the forefoot area 288 of the sole 278, the support plate 280 provides additional rigidity to the forefoot area 288 of the upper midsole 282 while the user's foot rocks onto the forefoot area. The support member 316 is compressed as the user's foot rocks to the forefoot area 288 and applies pressure to the support member 316 and then expands back to an initial non-compressed position as pressure is released from the support plate 280 and the support member 316 to help propel the user in a forward direction during use.

Referring to FIGS. 29-42, another embodiment of the sole 350 is shown where an upper surface 352 of the sole is attached to an upper 354 and includes a through-hole 356 that extends from the medial side 358 to the lateral side 360 of the sole. In this embodiment, the through-hole 356 is formed in the sole 350 during a molding process or cut out of the sole by a cutting device after the sole has been molded. As shown, the through-hole 356 is formed by a first wall 362, a second wall 364, a third wall 366 and a fourth wall 368 of the sole 350 and has a non-symmetrical, trapezoidal shape. The first wall 362 and the second wall 364 are joined to form a peak 370 that points toward the upper 354 and the third wall 366 extends from an end of the first wall 362 toward the front end of the sole 350. The fourth wall 368 joins the ends of the third wall 366 and the second wall 364. In the illustrated embodiment, the through-hole 356 formed by the walls 362, 364, 366 and 368, has a trapezoidal shape but may also have a triangular shape, an oval shape or any suitable shape.

A support member 372 shown in FIGS. 30-33 is inserted into the through-hole 356 and secured in place by a friction fit or by an adhesive. In this embodiment, the support member 372 has an upper support 374 and a lower support 376 that are integrally formed together. In another embodiment, the upper and lower supports 374, 376 are formed separately and placed adjacent to each within the through-hole 356, or are joined together by an adhesive or joined together by heating the upper and lower supports and pressing the supports together. In the illustrated embodiment, the upper and lower supports 374, 376 each have a medial member 378 and a lateral member 380 and cut out portions 382*a* and 382*b* on the front end and the rear end of the upper and lower supports that combine to form an H-shape. In this embodiment, the cut out portions 382*a*, 382*b* each have a generally semi-circular shape and are located in a central area 384 of the first and second supports. It is contemplated that the cut out portions 382*a*, 382*b* may also have a V-shape, a square shape, a rectangular shape or any suitable shape. In this embodiment, the cut out portions 382*a*, 382*b* have the same size and shape. In another embodiment, the cut out portions 382*a*, 382*b* each have a different size or a different shape or a different size and shape. Preferably, the support member 372 is made of a semi-rigid, resilient material such as EVA or plastic, but may be made with any suitable material or combination of materials. As shown the upper and lower supports 374, 376 have a thickness of 1.5 to 2.5 mm where the thickness of the upper support 374 is the same as the thickness of the lower support 376. In another embodiment, the thicknesses of the upper support 374 and the lower support 376 are different.

Figure 36:
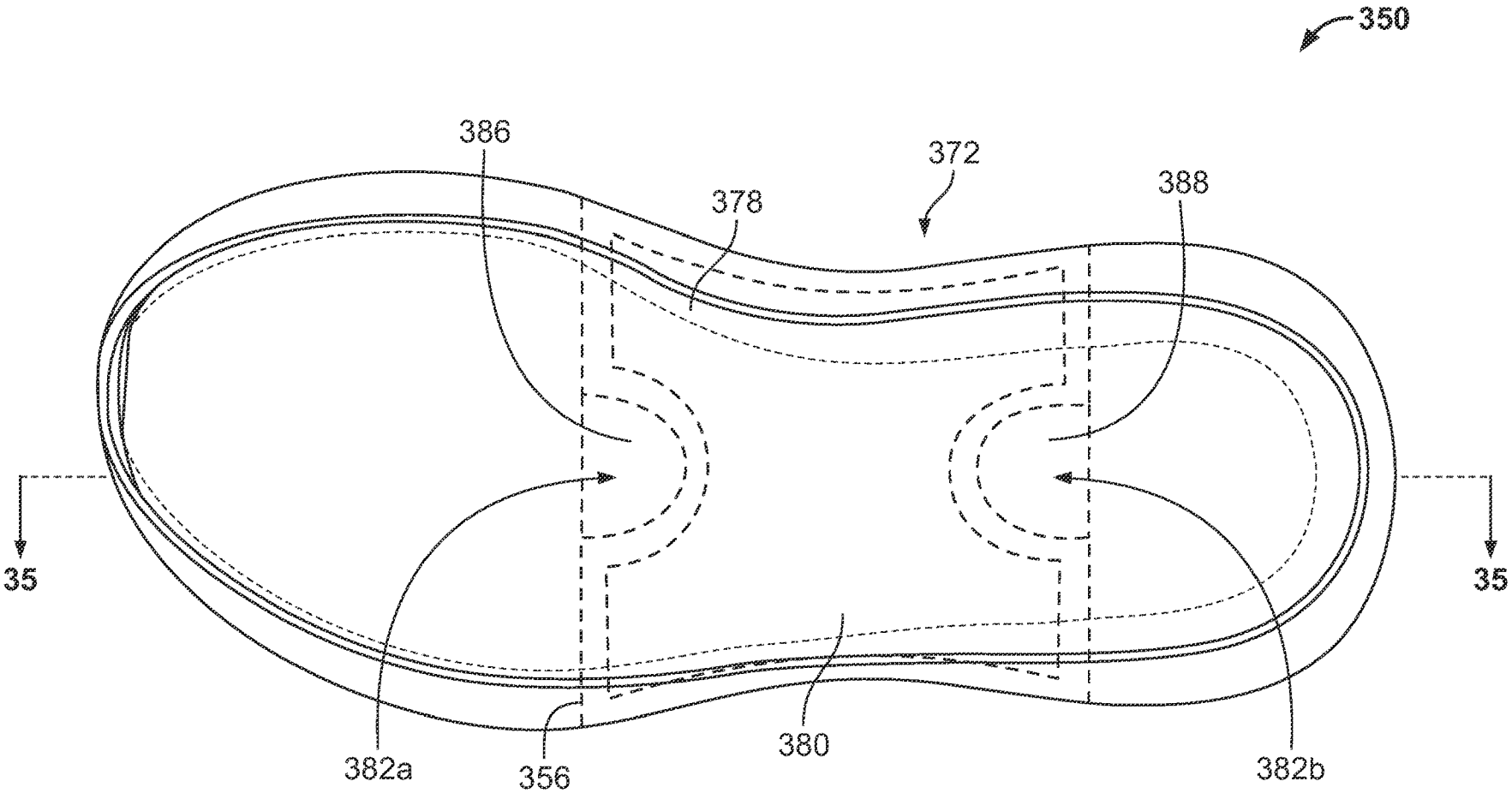
FIG. 36 is a top view of the sole of FIG. 29.
Figure 37:
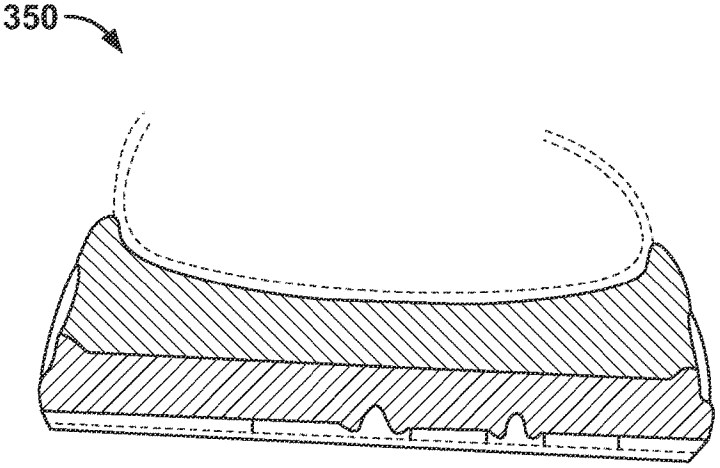
FIG. 37 is a cross-section view taken generally along the line 37-37 in FIG. 35 in the direction generally indicated.
Figure 38:
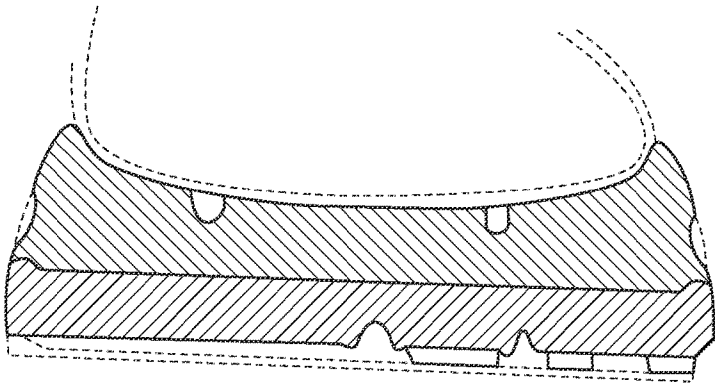
FIG. 38 is a cross-section view taken generally along the line 38-38 in FIG. 35 in the direction generally indicated.
Figure 39:
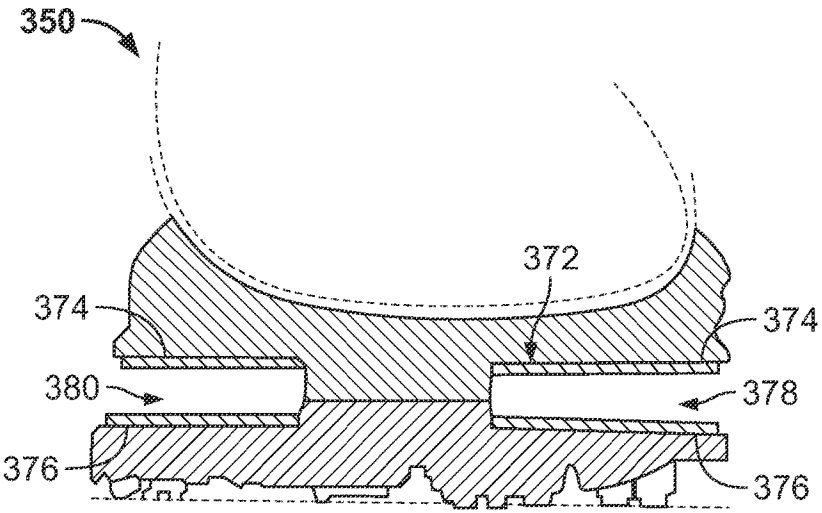
FIG. 39 is a cross-section view taken generally along the line 39-39 in FIG. 35 in the direction generally indicated.
Figure 40:
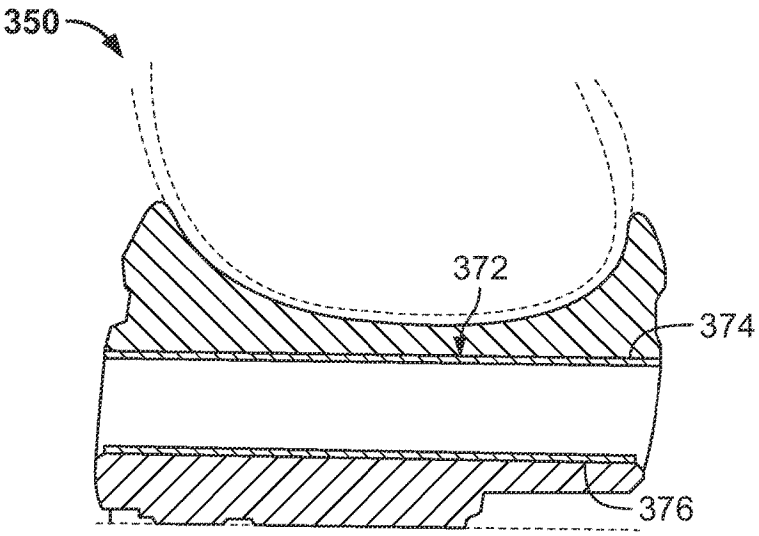
FIG. 40 is a cross-section view taken generally along the line 40-40 in FIG. 35 in the direction generally indicated.
Figure 41:
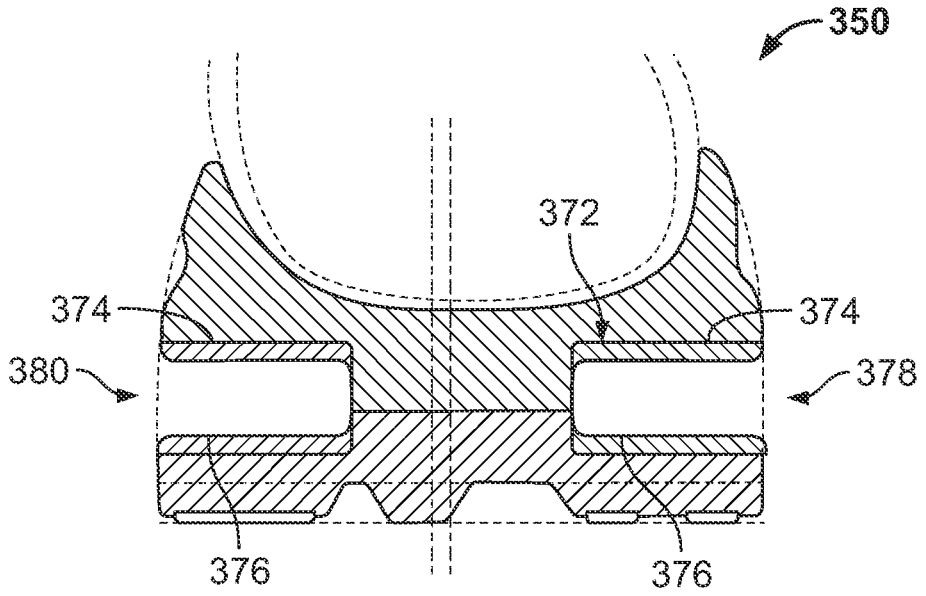
FIG. 41 is a cross-section view taken generally along the line 41-41 in FIG. 35 in the direction generally indicated.
Figure 42:
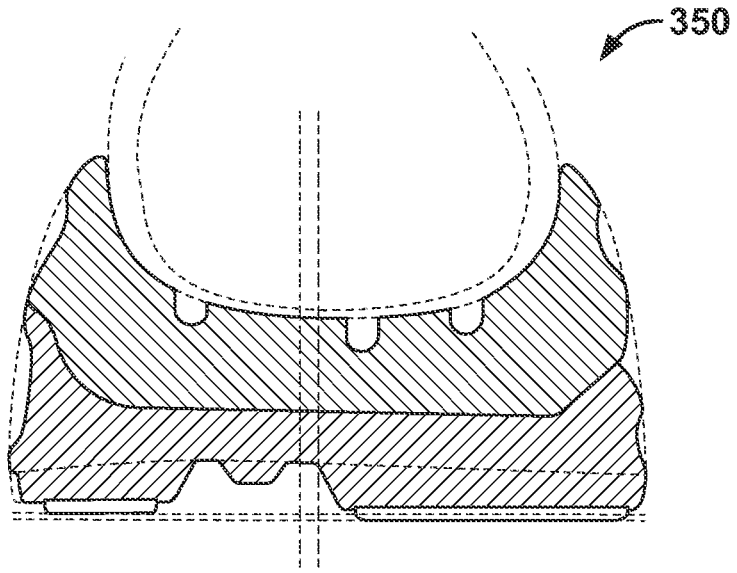
FIG. 42 is a cross-section view taken generally along the line 42-42 in FIG. 35 in the direction generally indicated.

As shown in FIGS. 36 and 39-41, the support member 372 conforms to the shape of the through-hole 356 when the support member is inserted into and secured in the through-hole. In this way, the longer sides of the upper and lower support members 374, 376 formed by the medial member 378 and the lateral member 380, which are on the opposing sides of the cut out portions 382*a*, 382*b*, are located on the medial and lateral sides of the sole. The central area 384 of the support member 372 is located between the cut out portions 382*a*, 382*b* and positioned on or near the center of the sole 350 as shown in FIG. 36.

In this embodiment, insert members 386 and 388, which are pieces of EVA or a foam material, are placed in the cut out portions 382*a*, 382*b* to provide cushioning and support to a user's foot. The insert members 386, 388 have a size and shape that conform to the size and shape of the cut out portions 382*a*, 382*b* where the insert members extend through the cut out portions and at least partially above the cut out portions. The insert members 386, 388 may be made with the same material as the sole 350 or made with a different material or combination of materials. As shown, the insert members 386, 388 help to control the compression and expansion of the support member 372 during use. As such, the amount of compression and expansion of the support member 372 may be changed by changing the material used to make the insert members 386, 388. For example, when the insert members 386, 388 have a high hardness value, the insert members provide more support to a user's foot and less compression of the support member 372. Alternatively, when the insert members 386, 388 have a low hardness value, the insert members provide less support to a user's foot and allow for more compression of the support member 372. In the illustrated embodiment, the insert members 386, 388 are made of the same material. It should be appreciated that the insert members 386, 388 may also be made of different materials to provide different levels of support and compression at different areas of the sole 350. In another embodiment, the sole 350 is formed to include integral insert portions (not shown) that extend into the cut out portions 382*a*, 382*b* of the support member 372 and have the same size, shape and function as the insert members 386, 388. The insert portions of the sole 350 may be made with the same material as the sole or made with a different material from the sole. Similarly, the insert portions of the sole 350 may each be made of the same material or each made with different materials. In this embodiment, the insert portions of the sole 350 are made with EVA but may be made with a foam material or any suitable material or combination of materials.

The support member 372 in this embodiment provides more support on the lateral and medial sides of the sole 350 and more cushioning in the center or central part of the sole near the cut out portions 382*a*, 382*b*. As stated above, the support and cushioning provided near the cut out portions 382*a*, 382*b* may be adjusted by placing an insert member made of EVA or a foam material in the cut out portions or by forming a portion or portions of the sole to extend within the cut out portions 382*a*, 382*b* with a softer material (lower hardness, i.e., lower hardness value, than the hardness of the rest of the sole) or with a harder or rigid material (higher hardness, i.e., higher hardness value, than the hardness of the rest of the sole).

During use, the peak 370 of the through-hole 356 and thereby the peak 371 of the support member 372 initially compresses during a heel strike (heel impacting the ground), which also compresses the insert member 386 that is closer to the heel, and then the peak 371 of the support member and the insert member 386 begin to rebound to a non-compressed position as the user's foot pivots or rocks toward the midfoot area the sole 350. The pressure of the user's foot on the central area 384 of the support member 372, as their weight transitions to the midfoot area of the sole 350, causes the central area 384 of the support member to compress. As the user's foot rocks toward the forefoot area of the sole 350, the peak 370 of the support member 372 returns to a non-compressed position and the front of the support member and the insert member 388 each compress from the pressure applied by the user's foot. When the user's foot further rocks to the toe area of the sole 350, the front of the support member 372 and the insert member 388 begin to rebound to a non-compressed position and pushes on the user's foot to help propel the user's foot and the user in a forward direction. The pressure on the support member 372 is then released as the user lifts their foot off of the ground and the support member returns to the non-compressed position.

During compression of the support member 372, the medial and lateral members 378 and 380 of the support member provide support to the medial and lateral sides of a user's foot during movement. The narrow central area 384 of the support member 372, which is located between the cut out portions 382*a*, 382*b*, provides less support and more cushioning to the user's foot. In this way, the support member 372 provides support and propulsion to the user's foot as well as stability to the medial and lateral sides of the user's foot during movement while also providing substantial comfort so that movement, such as walking or running, in shoes having the sole 350 and the support member 372 described above, is efficient and smooth.

Referring to FIGS. 43 to 47, other embodiments of the support member are shown where the different embodiments provide different levels of support and cushioning to a user's foot during movement.

Figure 43:
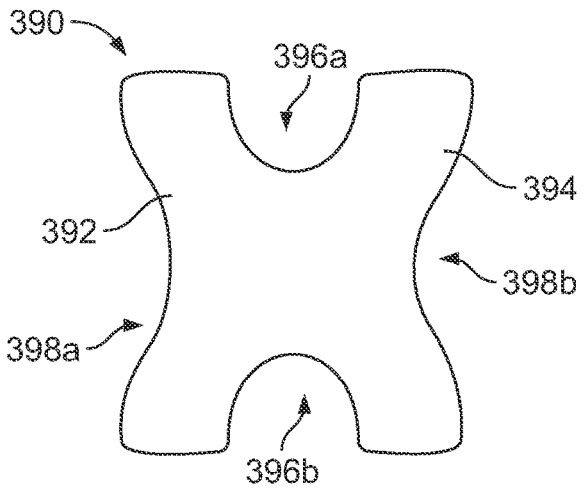
FIG. 43 is another embodiment of the support member of FIG. 29.

FIG. 43 shows an embodiment of a support member 390 in which the support member has a medial member 392, a lateral member 394 and cutout portions 396*a* and 396*b*. In this embodiment, the cutout portions 396*a*, 396*b* have the same size and shape and the medial member 392 and the lateral member 394 each have an indented portion 398*a* and 398*b*. The indented portions 398*a*, 398*b* formed in the medial and lateral members 392, 394 alter the level of support provided by the support member 390 along the lengths of the medial and lateral sides of the sole. It should be appreciated that the indented portions 398*a*, 398*b* may have the same size and shape or have different sizes and/or different shapes.

Figure 44:
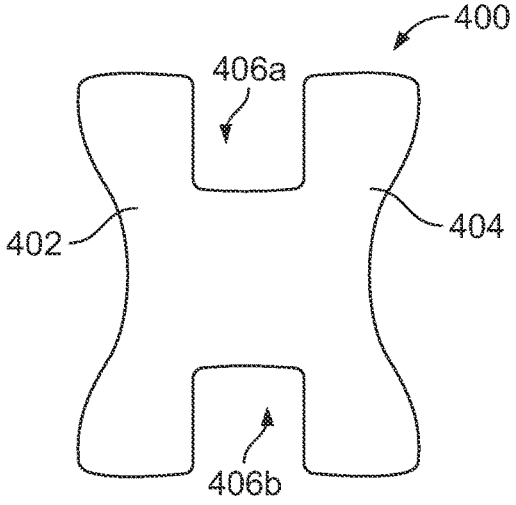
FIG. 44 is a further embodiment of the support member of FIG. 29.
Figure 45:
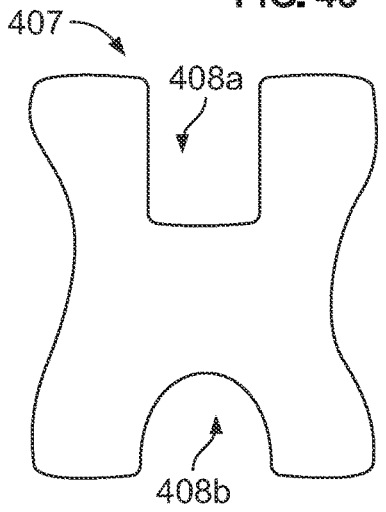
FIG. 45 is another embodiment of the support member of FIG. 29.

FIG. 44 shows another embodiment of a support member 400 in which the support member has a medial member 402, a lateral member 404 and cutout portions 406*a*, 406*b*. In this embodiment, the cutout portions 406*a*, 406*b* have a square shape, which is different from the shape of the cutout portions in the above embodiments. It should be appreciated that the cutout portions 406*a*, 406*b* may have a semi-circular shape, a square shape, a rectangular shape or any suitable shape. Further, the cutout portions 406*a*, 406*b* may be the same size or different sizes based on the level of support being provided by the support member 400. As shown in FIG. 45, in a further embodiment of a support member 407, the cutout portions 408*a* and 408*b* each have different shapes.

Figure 46:
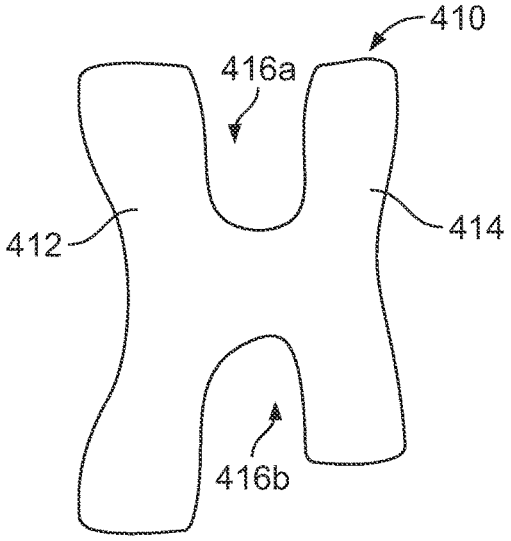
FIG. 46 is a further embodiment of the support member of FIG. 29.
Figure 47:
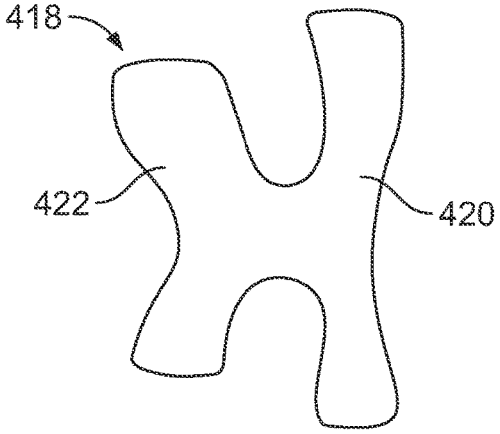
FIG. 47 is another embodiment of the support member of FIG. 29.

FIG. 46 shows an embodiment of a support member 410 in which the support member includes a medial member 412, a lateral member 414 and cutout portions 416*a*, 416*b*. The cutout portions 416*a*, 416*b* each have a semi-circular shape and are the same size. In this embodiment, the medial member 412 has a length that is greater than a length of the lateral member 414 such that a front end 416 of the medial member 412 extends to a point on the medial side of the sole 410 that is closer to a front end of the sole than the lateral member 414 extends to on the lateral side of the sole. Configuring the medial member 412 of the support member 410 to be longer than the lateral member 414 enables the support member to provide more support on the medial side than on the lateral side of the sole. It should be appreciated that the medial member 412 may have a length that is greater than the length of the lateral member 414 (extends further along the medial side than on the lateral side) on one end or both ends of the support member 410. Further, the lateral member 414 may have a length that is greater than the length of the medial member 412 on one end or both ends of the support member 410. For example, FIG. 47 shows another embodiment of a support member 418 in which the lateral member 420 has an overall length that is greater than an overall length of the medial member 422 at both ends of the support member due to the lateral member extending beyond the medial member at both ends of the support member.

While particular embodiments of the present sole for an article of footwear have been shown and described, it will be appreciated by those skilled in the art that changes and modifications may be made thereto without departing from the invention in its broader aspects and as set forth in the following claims.

What is claimed is:

1. An article of footwear comprising:

an upper;

a sole attached to said upper, said sole including a midsole having a medial side and a lateral side, said midsole including a through-hole extending between said medial side and said lateral side, said through-hole being spaced from a bottom surface of said midsole; and a plurality of support members in said through-hole, at least two of the plurality of support members being a different size.

2. The article of footwear of claim 1, wherein at least one of said support members includes a first member and a second member, said first member and said second member being separate from each other and each having an upper end and a lower end, wherein said upper ends and said lower ends of said first member and said second member at least partially overlap each other.

3. The article of footwear of claim 1, wherein each of said support members has rounded ends connected by a substantially straight portion.

4. The article of footwear of claim 1, wherein said plurality of support members are positioned end-to-end within through-hole.

5. The article of footwear of claim 1, wherein said support members gradually decrease in size from a rear end to a front end of said sole.

6. The article of footwear of claim 1, wherein said support members are each made of a foam material or ethylene vinyl acetate.

7. The article of footwear of claim 1, wherein each of said support members includes a peripheral layer made with a first material and a internal area made of a second material.

8. The article of footwear of claim 1, wherein each of said support members is hollow.

9. The article of footwear of claim 1, wherein said support members are spaced from each other within said through-hole.

* * * * *